US007228089B2

(12) United States Patent
Saito et al.

(10) Patent No.: US 7,228,089 B2
(45) Date of Patent: Jun. 5, 2007

(54) IMAGE FORMING APPARATUS AND DEVELOPER REPLENISHMENT PORTION

(75) Inventors: Manabu Saito, Iwatsuki (JP); Hidekazu Amamoto, Iwatsuki (JP); Atsuna Saiki, Iwatsuki (JP); Takaharu Abe, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 196 days.

(21) Appl. No.: 10/827,310

(22) Filed: Apr. 20, 2004

(65) Prior Publication Data

US 2005/0002683 A1 Jan. 6, 2005

Related U.S. Application Data

(63) Continuation-in-part of application No. 10/226,305, filed on Aug. 23, 2002, now Pat. No. 6,792,230, and a continuation-in-part of application No. 10/366,322, filed on Feb. 14, 2003, now abandoned.

(30) Foreign Application Priority Data

Dec. 20, 2001 (JP) ..... 2001-388372
Sep. 6, 2002 (JP) ..... 2002-261911

(51) Int. Cl.
*G03G 15/00* (2006.01)
*G03G 21/16* (2006.01)

(52) U.S. Cl. ..... 399/107; 399/111

(58) Field of Classification Search ..... 399/111, 399/119, 177, 107
See application file for complete search history.

(56) References Cited

U.S. PATENT DOCUMENTS 5,126,799 A 6/1992 Matsuura et al.
5,289,241 A 2/1994 Sugiyama et al.
5,291,254 A 3/1994 Shimada et al.
5,315,362 A 5/1994 Fuji et al.
5,438,391 A 8/1995 Maekawa et al.
5,543,891 A 8/1996 Setoriyama
5,729,804 A 3/1998 Aruga et al.
5,899,602 A 5/1999 Noda et al.
6,081,683 A 6/2000 Miyasaka et al.
6,463,234 B2 10/2002 Arimitsu et al.
6,549,737 B2 4/2003 Sano et al.

(Continued)

FOREIGN PATENT DOCUMENTS

JP U-01-136944 9/1989

(Continued)

*Primary Examiner*—Susan Lee
(74) *Attorney, Agent, or Firm*—Oliff & Berridge, PLC

(57) ABSTRACT

A recording medium supplied from any one of paper supply units is printed by an image forming section, and then, the image-formed recording medium is transported via a transport path which is formed along a vertical direction, and thereafter is ejected to an ejection unit which is provided at an upper portion of an image forming apparatus main body. While a developing apparatus of a process cartridge owns a developer storage space, a latent image writing position "P" of an image carrier optically written by an optical writing apparatus is located lower than at least a portion of this developer storage space, and a space defined between the paper supply unit 18*a* and the optical writing apparatus is made small.

12 Claims, 27 Drawing Sheets

U.S. PATENT DOCUMENTS 6,792,230 B2 * 9/2004 Saito et al. ..... 399/111

FOREIGN PATENT DOCUMENTS

| | | | |
|---|---|---|---|
| JP | A-03-274754 | | 12/1991 |
| JP | A-04-070867 | | 3/1992 |
| JP | A-04-127167 | | 4/1992 |
| JP | A-04-318875 | | 11/1992 |
| JP | A-05-173375 | | 7/1993 |
| JP | A-05-173376 | | 7/1993 |
| JP | A 6-12475 | | 1/1994 |
| JP | B2 6-12475 | | 2/1994 |
| JP | A-06-110262 | | 4/1994 |
| JP | 7-168507 | A | 7/1995 |
| JP | 8-123297 | | 5/1996 |
| JP | A-08-160820 | | 6/1996 |
| JP | A-08-305246 | | 11/1996 |
| JP | A-09-101734 | | 4/1997 |
| JP | A-09-106123 | | 4/1997 |
| JP | 10282853 | A * | 10/1998 |
| JP | A-2000-356882 | | 12/2000 |

* cited by examiner

IMAGE FORMING APPARATUS AND DEVELOPER REPLENISHMENT PORTION

This is a Continuation-in-Part of application Ser. No. 10/226,305 filed Aug. 23, 2002 now U.S. Pat. No. 6,792, 230, which claims the benefit of Japanese Patent Application No. JP 2001-388372 filed Dec. 20, 2001, and is a Continuation-in-Part of application Ser. No. 10/366,322 filed Feb. 14, 2003 now abandoned, which claims the benefit of Japanese Patent Application No. JP 2002-261911 filed Sep. 6, 2002. The entire disclosure of the prior application is hereby incorporated by reference herein in its entirety.

BACKGROUND OF THE INVENTION

1. Field of Invention

The present invention is related to an electro-photographic type image forming apparatus.

2. Description of Related Art

As this sort of image forming apparatus, such an image forming apparatus is known in which while a recording medium is transported along a substantially vertical direction, an image is formed on this transported recording medium, and then, the recording medium on which the image has been formed is ejected to an ejection unit provided on an upper portion of a main body of this image forming apparatus as disclosed in JP-A-10-207160.

The above-described prior art is represented in FIG. 6. In this prior art, a recording medium which has been transported from a paper supply unit 200 by a transport roller 202 is traveled through a transport path 204 which is formed along a substantially vertical direction, and an image is formed on this recording medium by an image forming section 206, and then, this recording medium on which the image has been formed is ejected to an ejection unit 210 which is formed at an upper portion of a main body 208 of the image forming apparatus. The image forming section 206 contains an image carrier 212 constructed of a photosensitive member, a charging apparatus 214 for charging this image carrier 212, an optical writing apparatus 216, a developing apparatus 218, a transferring apparatus 200, a cleaning apparatus 222, and also a fixing apparatus 224. The charging apparatus 214 charges this image carrier 212. The optical writing apparatus 216 forms a latent image on the image carrier 214 charged by this charging apparatus 214. The developing apparatus 218 develops the latent image of the image carrier 214 formed by this optical writing apparatus 216 so as to produce a visible toner image. The transferring apparatus 218 transfers the toner image of the image carrier 214 developed by this developing apparatus 218 onto the recording medium. The cleaning apparatus 222 is constituted by a blade for cleaning developer left on the image carrier 214. The fixing apparatus 224 fixes the toner image which has been transferred onto the recording medium.

The optical writing apparatus 216 is constituted by a scanning type laser exposing apparatus, and is arranged on the side of the developing apparatus 218. In this prior art, when reliability is taken into account, it is preferable to arrange the optical writing apparatus 216 along a horizontal direction. However, since this optical writing apparatus 216 is arranged along an oblique direction, such a device capable of reducing a width of this optical writing apparatus 216 along forward/backward directions (namely, right/left directions as viewed in FIG. 6) can be made.

However, in such a type of image forming apparatus that the recording medium is transported along the substantially vertical direction, dead spaces 226 and 228 are formed at both upper/lower portions of the optical writing apparatus 216 within the ejection unit 210 provided at the upper portion of this image forming apparatus. In other words, since the developing apparatus 218 is arranged at a position lower than a latent image writing position "P" where the latent image is written onto the image carrier 212 by the optical writing apparatus 216, the optical writing apparatus 216 must be arranged above the developing apparatus 218. As a result, the dead space 226 is formed between the ejection unit 210 and the optical writing apparatus 216, and also, the dead space 228 is formed between the optical writing apparatus 216 and the paper supply unit 200.

Moreover, conventionally, an image is transferred onto the image carrying body, while transporting the recording sheet in the substantially vertical direction, and scanning light is laterally incident on the image carrying body.

In this case, a toner replenishment box is disposed in downstream (in a lower part in this instance) of a latent image writing position on the image carrying body. Accordingly, the toner replenishment box does not hinder the operation of writing the latent image onto the image carrying body.

However, in this type of technique, the toner replenishment box is disposed in downstream (in a lower part in this instance) of a scanning light incident position. Therefore, for example, when the amount of toner is increased, the toner amount increase more easily affects the positions of a sheet tray and the optical unit, which are disposed in the lower part, since the volume of the toner replenishment box is increased. Changes to the specification of the machine, caused by the toner replenishing amount change, are not uniform. This makes it difficult to use the image forming apparatus in common for different specifications. An additional problem is that with increase of the toner replenishing amount, the machine size tends to increase.

Further, in a case where the machine is designed so as to allow the toner replenishment box to be pulled out from an upper part of the machine body, it entails that it is difficult to install another device in an upper space of the toner replenishment box. An additional technical problem arises that a dead space is easy to be formed in upstream (in an upper part in this instance) of the scanning light incident position.

Particularly in a case where the process cartridge is equipped with the toner replenishment box, such a technical problem is more remarkable by the amount of its occupied space increase.

SUMMARY OF THE INVENTION

An object of the present invention is to provide an image forming apparatus capable of reducing a dead space, otherwise, by which even when such a dead space is formed, this dead space can be effectively utilized.

To achieve the above-described object, a first feature of the present invention is to provide an image forming apparatus comprising: an image forming apparatus main body in which an ejection unit is provided at an upper portion thereof; a recording medium storage section arranged along a substantially horizontal direction; a transport path for transporting a recording medium supplied from the recording medium storage section along a substantially vertical direction, and for ejecting the transported recording medium to the ejection unit of the image forming apparatus main body; an image carrier; an optical writing section for forming an electrostatic latent image on the image carrier; and developing section for developing the electrostatic latent image formed on the image carrier to produce a visible image; in which the developing section owns a developer storage space for storing thereinto developer; and a latent image writing position of the image carrier written by the optical writing apparatus is located lower than at least a portion of the developer storage space along the vertical direction. As a consequence, since the latent image writing position written by the optical writing apparatus is located at the lower position, the space defined between the optical writing apparatus and the recording medium storage section can be made smaller than that of the conventional image forming apparatus.

Although a laser apparatus and/or an LED (Light Emitting Diode) may be employed as the optical writing apparatus, a scanning type laser exposing apparatus is employed. This scanning type laser exposing apparatus may be arranged along a substantially horizontal direction, so that the space defined between the optical writing apparatus and the recording medium storage section arranged along the substantially horizontal direction may be made smaller. As the optical system of the scanning type laser exposing apparatus, there are both an over-field type optical system and an under-field type optical system. In this over-field type optical system, a width of a luminous flux entered into a rotary polygon along a main scanning direction is made wider than a plane width of this rotary polygon. In the under-field type optical system, a width of a luminous flux entered into a rotary polygon along a main scanning direction is made narrower than a plane width of this rotary polygon. In such a case that a plurality of machine sorts of image forming apparatus are wanted to be manufactured in which printing speeds thereof and maximum paper sizes thereof are changed, while image forming apparatus main bodies and the like are commonly utilized, the over-field type optical system is employed when either a high printing speed or a larger maximum paper size is realized, whereas the under-field type optical system is employed when either a low printing speed or a smaller maximum paper size is realized. Generally speaking, since an optical path of an over-field type optical system is long and complex, a larger installation space is required, as compared with that of an under-field type optical system. To the contrary, in such a case that the optical writing apparatus is arranged along the substantially horizontal direction, a lower space of an ejection unit is extended. As a result, if this lower space is made coincident with the storage capacity of the over-field type, then both the over-field type optical system and the under-field type optical system can be properly utilized while the dead space is suppressed to a minimum dead space.

Also, the optical writing apparatus may be preferably arranged on the front surface side of the image forming apparatus main body.

Also, a control board for controlling drives of the respective components of the image forming apparatus, a network interface board used to constitute a network, or a developer storage vessel for storing thereinto developer is arranged in another space defined between the ejection unit and the optical writing apparatus, sot that this space can be effectively utilized.

As explained above, in order that the developer storage space is formed at the position higher than the latent image writing position written by the optical writing apparatus, the developer storage space is subdivided into a first developer storage portion arranged at an upper portion thereof, and a second developer storage portion arranged at a lower portion thereof, and also, a window portion is formed between these first and second developer storage portions. As a result, an optical scanning path from the optical writing apparatus can be constituted by this window portion. Also, when such a construction is made that at least a portion of the optical writing apparatus is arranged to be overlapped with respect to the developer storage space along a direction in parallel to an optical axis of incident light to the image carrier, since the incident light optical axial direction of the image forming apparatus can be made short, the better construction of the image forming apparatus can be realized.

Furthermore, according to embodiments of the invention, there is provided an image forming apparatus including a latent image forming unit and a developing unit. The latent image forming unit forms a latent image on an image carrying body. The developing unit visualizes the latent image formed on the image carrying body by using a developer. A developing housing containing the developer is communicatively connected to a developer replenishment box. The developer replenishment box is disposed in an upstream of a latent image writing position on the image carrying body.

DETAILED DESCRIPTION OF PREFERRED EMBODIMENTS

Referring now to drawings, embodiment modes of the present invention will be described.

Figure 1:
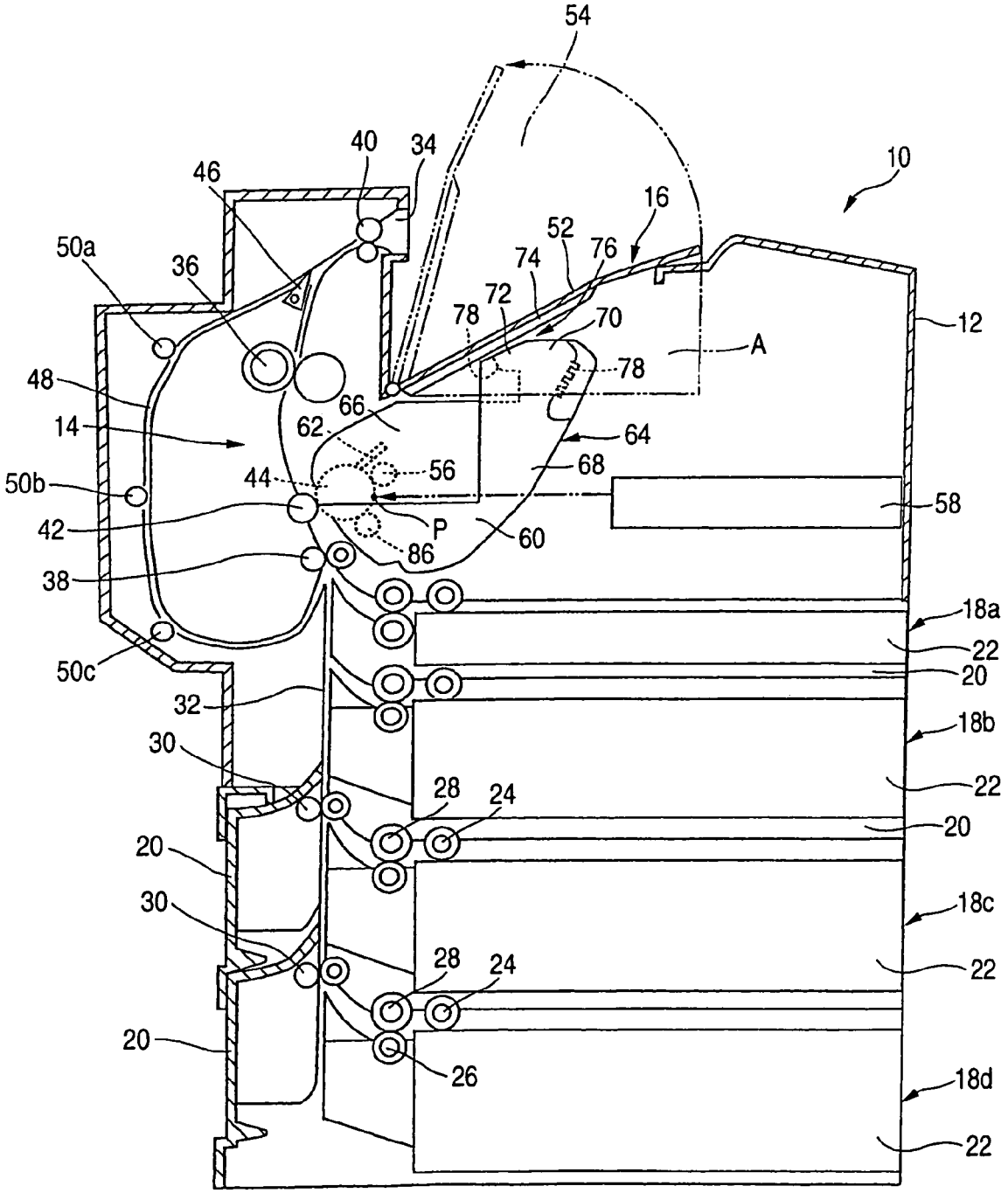
FIG. 1 is a sectional view for indicating an image forming apparatus according to a first embodiment mode of the present invention.

FIG. 1 schematically shows an image forming apparatus 10 according to a first embodiment mode of the present invention. The image forming apparatus 10 contains a main body 12 of the image forming apparatus. An image forming section 14 is mounted on this image forming apparatus main body 12. An ejection unit 16 (will be explained later) is provided at an upper portion of this image forming apparatus main body 12, and also, for instance, two stages of paper supply units 18a and 18*b* are arranged at a lower portion of this image forming apparatus main body 12. Furthermore, two stages of paper supply units 18*c* and 18*d* are arranged below the image forming apparatus main body 12, while these paper supply units 18*c* and 18*d* are detachably mounted thereon as an optional paper supply unit.

Each of the paper supply units 18*a* to 18*d* owns a paper supply unit main body 20 and a paper supply cassette 22 into which paper is stored. The paper supply cassette 22 is slidably mounted with respect to the paper supply unit main body 20, and is drawn out from this paper supply unit main body 20 along a front plane direction (namely, right direction of FIG. 1). Also, a paper supply roller 24 is arranged at an upper portion near an inner end of the paper supply cassette 22, and both a retard roller 26 and a nudger roller 28 are arranged in front of this paper supply roller 24. Furthermore, feed rollers 30 are provided with the optionally-provided paper supply units 18*c* and 18d, and these feed rollers 30 may constitute a pair of feed rollers.

A transport path 32 corresponds to a paper path defined from the feed roller 30 of the lowermost paper supply unit 18*d* up to an ejection port 34. While this transport path 32 is located in the vicinity of a rear surface (namely, left side surface viewed in FIG. 1) of the image forming apparatus main body 12, this transport path 32 owns such a portion which is formed along the substantially vertical direction from the feed roller 30 of the lowermost paper supply unit 18*d* up to a fixing apparatus 36 (will be discussed later). Both a transferring apparatus 42 (will be explained later) and an image carrier 44 (will be explained later) are arranged on an upper stream side of the fixing apparatus 36 of this transport path 32. Furthermore, a register roller 38 is arranged on an upper stream side of both the transferring apparatus 42 and the image carrier 44. In addition, an ejection roller 40 is arranged in the vicinity of an ejection port 34 of the transport path 32.

As a result, the recording mediums which are fed out from the paper supply cassettes 22 of the paper supply units 18*a* to 18*d* are smoothly separated by the retard roller 26 and the nudger roller 28 to be conducted to the transport path 32, and then, are temporarily stopped by the register roller 38. After proper timing is controlled, a developer image is transferred to the recording medium while the recording medium is penetrated between the transferring apparatus 42 and the image carrier 44 (will be explained later), and this transferred developer image is fixed on the fixing apparatus 36, and then, the recording medium on which the fixed image has been formed is ejected from the ejection port 34 to the ejection unit 16 by the ejection roller 40.

It should be noted that when a double-surface printing mode is carried out, this recording medium is returned to an inversion path 48. In other words, a front path portion of the transport path 30 as to the ejection roller 40 is separated into two paths, a switching claw 46 is provided at this separated path portion, and the inversion path 48 is formed from this separated path portion up to the register roller 38. While transport rollers 50a to 50c are provided in this inversion path 48, in the case of the double-surface printing mode, the switching claw 46 is switched to such a side that the inversion path 48 is opened. Then, the ejection roller 40 is inverted at a time instant when a front edge portion of a recording medium is engaged with the ejection roller 40, so that this recording medium is conducted to the inversion path 48, and then, is penetrated through the register roller 38, the transfer apparatus 42, the image carrier 44, and the fixing apparatus 36 so as to be ejected from the ejection port 34 to the ejection unit 16.

The ejection unit 16 owns an inclination unit 52 which is freely pivotable with respect to the image forming apparatus main body 12. This inclination unit 52 is inclined in such a manner that an ejection port portion is low and is gradually heightened toward a front surface direction (namely, right direction viewed in FIG. 1). This ejection port portion is used as a lower end of the inclination unit 52 and a tip portion which is heightened is used as an upper end thereof. This inclination unit 52 is supported with respect to the image forming apparatus main body 12 in such a manner that this inclination unit 52 is freely pivotable, while the lower end thereof is located at a center. When this inclination unit 52 is rotated toward the upper direction so as to be opened, an open unit 54 is formed, and a process cartridge (will be explained later) 64 can be detachably mounted via this opening unit 54.

The image forming section 14 is made of, for instance, an electrophotographic type image forming unit. This image forming section 14 is arranged by the image carrier 44 constructed of a photosensitive material, a charging apparatus 56; an optical writing apparatus 58, a developing apparatus 60, a transferring apparatus 42, a cleaning apparatus 62, and a fixing apparatus 36. The charging apparatus 56 is constituted by, for example, a charge roller capable of uniformly charging the image carrier 44. The optical writing apparatus 58 writes a latent image in an optical manner on the image carrier 44 charged by the charging apparatus 56. The developing apparatus 60 develops the latent image of the image carrier 44, which has been formed by the optical writing apparatus 58, by way of developer so as to produce a visible image. The transferring apparatus 42 is constituted by, for example, a transfer roller which transfers the developer image by the developing apparatus 60 to paper. The cleaning apparatus 62 is constituted by, for instance, a blade which cleans the developer left on the image carrier 44. The fixing apparatus 36 is arranged by both a pressure-applying roller and a heating roller, by which the developer image which has been transferred onto the paper by the transferring apparatus 42 is fixed on this paper. The optical writing apparatus 58 is constructed of, for example, a scanning type laser exposing apparatus, and is arranged in parallel to the above-described paper supply units 18*a* to 18d, and is located in the vicinity of a front surface of the image forming apparatus menu body 12. As will be explained later, the optical writing apparatus 58 exposes the image carrier 44 by scanning light beams across the inner space of the developing apparatus 60. This exposing position of the image carrier 44 may constitute a latent image writing position "P". This exposing position "P" is located lower than an upper portion of a developer storage space (will be explained later) 70 along the vertical direction.

The optical writing apparatus 58 is arranged in a space "A" within the image forming apparatus main body 12, while this space "A" is surrounded by the ejection unit 16, the uppermost paper supply unit 18*a*, the process cartridge 64, and the front surface portion of the image forming apparatus main body 12. In this first embodiment mode, the optical writing apparatus 58 owns an under-field type optical system in which a width of a luminous flux entered into a rotary polygon along the main scanning direction is made narrower than a plane width of the rotary polygon. Since this optical writing apparatus 58 owns the under-field type optical system, a width of this optical writing apparatus 58 along the vertical direction is made narrower, and the under-field type optical system is arranged at a lower portion of the space "A" for arranging the optical writing apparatus 58. It should also be noted that this space "A" is set under such a condition that another optical writing apparatus 59 (denoted by two dot/dash line in FIG. 1) having an over-field type optical system may be accepted. In this over-field type optical system, a width of a luminous flux entered into a rotary polygon is made wider than a plane width of this rotary polygon. Thus, the above-described optical writing apparatus 58 may be replaced by this optical writing apparatus 59. Since this another optical writing apparatus 59 is mounted and the presently-used drive system is substituted by another drive system, the presently-used image forming apparatus 10 may be changed into either a high-speed type image forming apparatus or such an image forming apparatus having a larger maximum paper size than that of the presently-used image forming apparatus 10, while other components thereof are commonly used.

As explained in this first embodiment mode, when either the optical writing apparatus 58 or the optical writing apparatus 59 is arranged along the substantially horizontal direction, the rotary polygon may be rotated by being maintained along the substantially horizontal direction, so that reliability thereof with respect to the rotation of the rotary polygon may be improved.

It should also be noted that a door is provided on the front surface portion of the image forming apparatus main body 12, and then, since this door is opened/closed, the replacement of the optical writing apparatus 58 may be readily carried out.

The process cartridge 64 is arranged by employing the image carrier 44, the charging apparatus 54, the developing apparatus 58, and the cleaning apparatus 60 in an integral body. This process cartridge 64 is arranged just under the inclination unit 52 of the ejection unit 16, and as previously explained, is detachably mounted via the open portion 54 which is formed when the inclination unit 52 is opened.

This process cartridge 64 is detachably separated into an image carrier unit 66 and a developing apparatus unit 68. In the image carrier unit 66, the image carrier 44, the charging apparatus 54, and the cleaning apparatus 60 are arranged. In the developing apparatus unit 68, the developing apparatus 58 is arranged. The developing apparatus unit 68 owns a developer storage space 70 which stores thereinto, for example, developer. An upper portion of this developer storage unit 70 belongs to such an area which is surrounded by the inclination unit 52, a horizontal plane extended from the lower end of the inclination unit 52, and also, a vertical plane extended from the upper end of this inclination unit 52. Also, an upper wall plane 72 which constitutes the developer storage space 70 is formed in such a manner that this upper wall plane 72 is located in parallel to the inclination unit 52 and along this inclination unit 52. Also, a plurality of ribs 74 are formed on a lower surface of the inclination unit 52 in such a way that these plural ribs 74 are positioned in parallel to each other along the inclination direction of the inclination unit 52. Since these ribs 74 are formed, a flow path 76 is formed between the inclination unit 52 and the process cartridge 64. This flow path 76 is employed so as to penetrate air therethrough, and this flow path 76 may disperse heat produced from the fixing apparatus 36. Furthermore, a grip unit 78 is formed on the upper portion of the developer storage space 70. This grip unit 78 is formed in such a manner that wall surfaces of both sides of the upper portion of the developer storage space 70 are entered into the inside thereof. When the process cartridge 64 is detachably mounted, this process cartridge 64 can be readily detachably mounted by gripping this grip unit 78.

Figure 2:
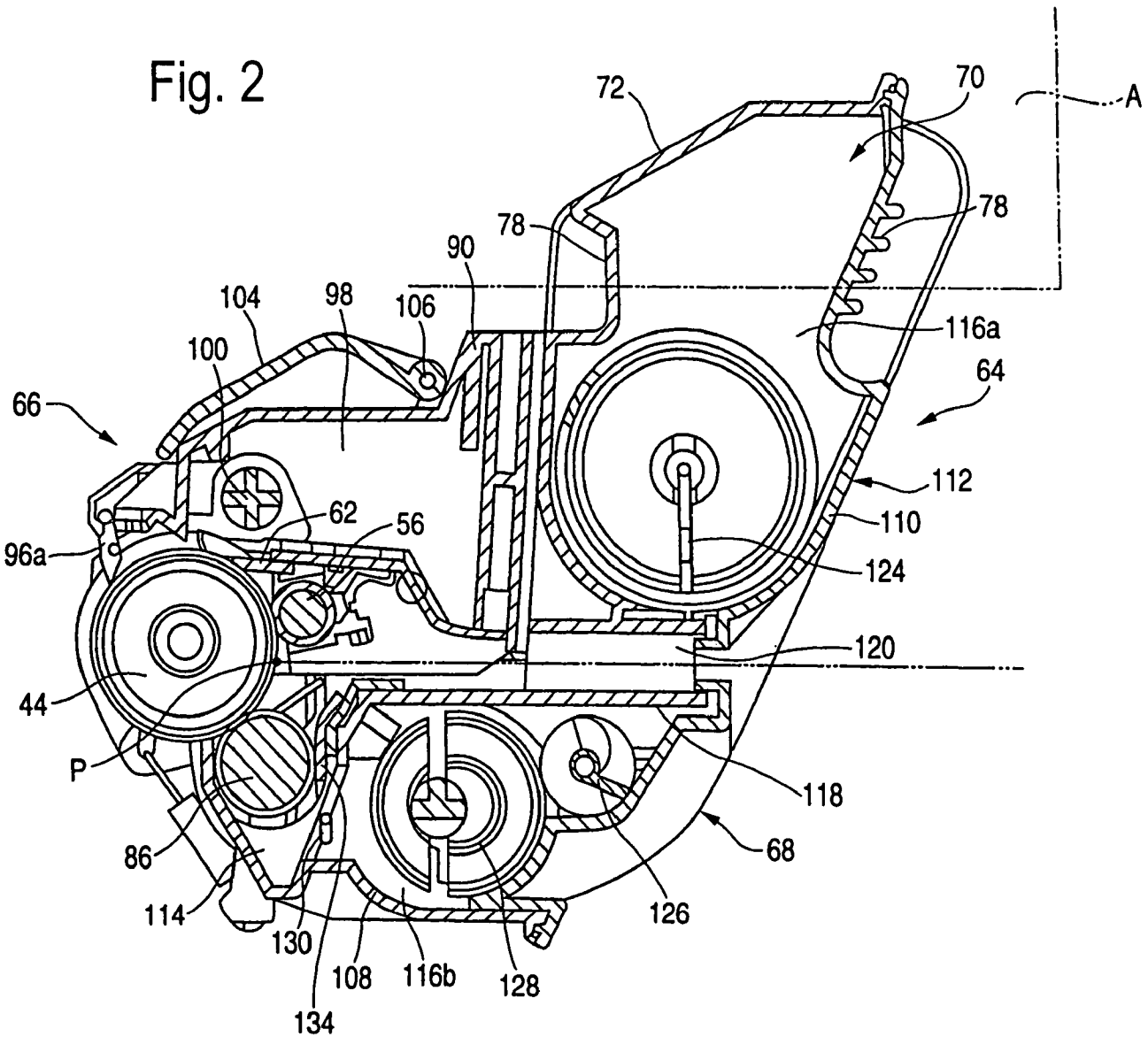
FIG. 2 is a sectional view for representing a process cartridge employed in the image forming apparatus according to the first embodiment mode of the present invention.
Figure 3:
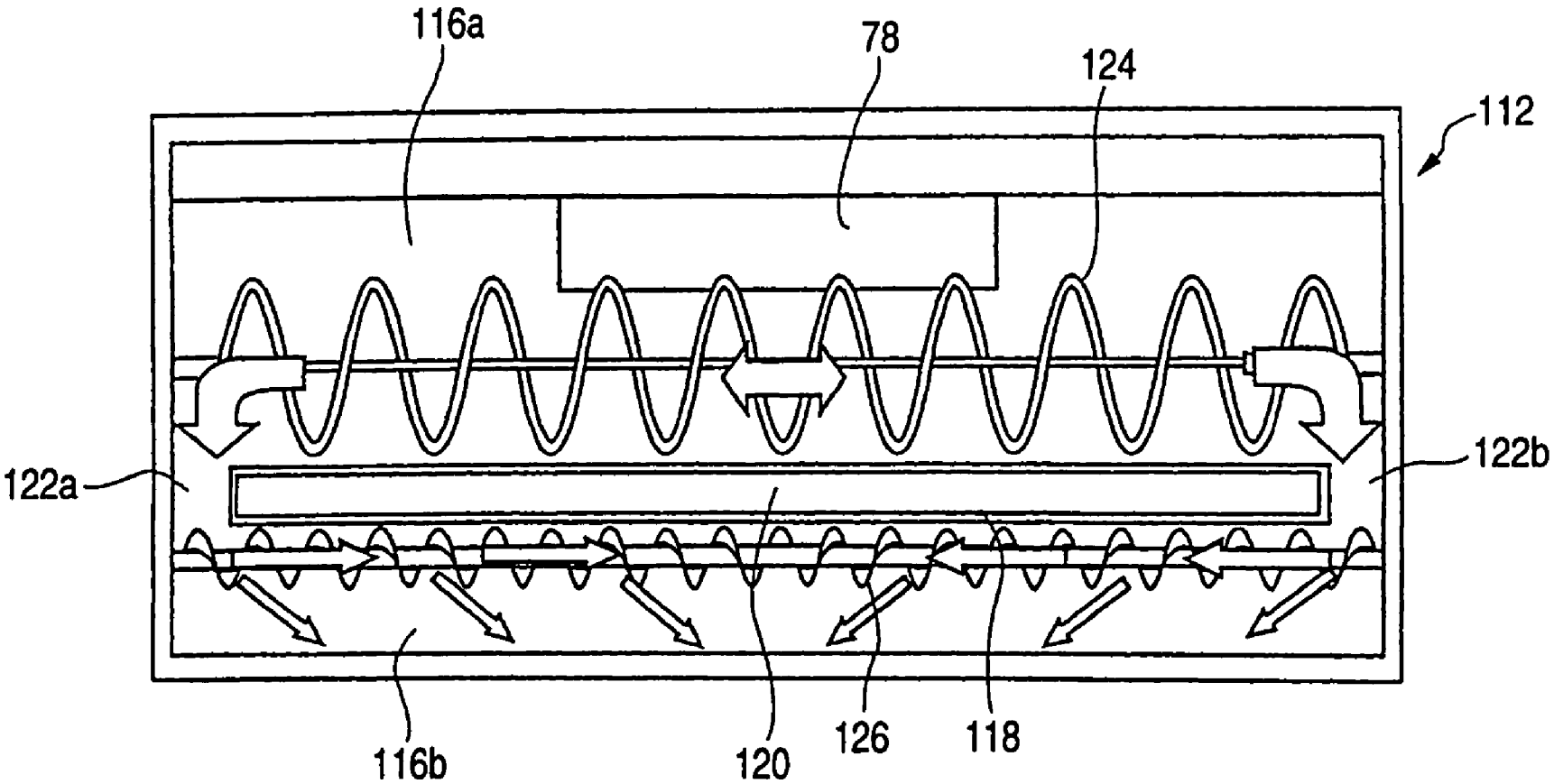
FIG. 3 is a side view for showing a supply path of developer in the process cartridge employed in the image forming apparatus according to the first embodiment mode of the present invention.

In FIG. 2 and FIG. 3, a detailed construction of the above-described process cartridge 64 is indicated. As explained above, the process cartridge 64 is arranged by the image carrier unit 66 and the developing apparatus unit 68, and this image carrier unit 66 is coupled to the developing apparatus unit 68 via a coupling pin (not shown) in such a manner that this image carrier unit 66 is freely pivotable with respect to the developing apparatus unit 68. Also, both the image carrier unit 66 and the developing apparatus 68 are energized with each other by a spring (not shown), and a developing roller 86 is depressed against the image carrier 44.

The image carrier unit 66 owns a main body 90 of the image carrier unit 66, and both the image carrier 44 and the charging apparatus 56 are supported by this image carrier unit main body 90 in such a manner that both the image carrier 44 and the charging apparatus 56 are rotatably supported. Both a bearing 94a and another bearing 94*b* for the charging apparatus 56 own another function of a power supply portion. Also, for example, two fingers 96 are supported by the image carrier unit main body 90 in such a manner that these fingers 96 are freely pivotable. Since tip portions of these fingers 96 are depressed on the surface of the image carrier 44, a recording medium which will wrap the image carrier 44 is stripped by these tip portions. Also, a developer collecting space 98 is formed above the cleaning apparatus (cleaning blade) 62 within the image carrier unit main body 90, and thus, developer which has been scratched/dropped by the cleaning apparatus 62 is collected into this developer collecting space 98. A paddle 100 is rotatably provided in this developer collecting space 98. This paddle 100 is supported by the image carrier unit main body 98, and transports the developer which has been collected by being rotated to an inner side of the developer collecting space 98. Also, a shutter 104 is provided at the upper portion of the image carrier unit main body 90 in such a manner that this shutter 104 can be freely opened/closed. This shutter 104 is supported via a shaft 106 for the shutter 104 with respect to the image carrier unit main body 90 in a freely movable manner. This shutter 104 closes an opening portion of the image carrier 44 before the process cartridge 64 is mounted, and is opened in order that the image carrier 44 is come out to the front in the case that the process cartridge 64 is mounted.

The developing apparatus unit 68 contains a main body 112 of the developing apparatus unit 68 which is constituted by jointing a front housing 108 to a rear housing 110. An inner space of this developing apparatus unit main body 112 is segmented into the above-described developer collecting space 70 and a developing unit 114 in which the developing roller 86 is arranged. The developer collecting space 70 is separated into a first developer storage portion 116*a* and a second developer storage portion 116*b* via a partition wall 118, while a horizontal line extended from the latent image writing position "P" is defined as a boundary. This horizontal line corresponds to a scanning optical path originated from the optical writing apparatus 58. The first developer collecting portion 116*a* is located at an upper portion of the developer collecting space 70, whereas the second developer storage portion 116*b* is located at a lower portion thereof.

As indicated in FIG. 3, the partition wall 118 forms a window portion 120 having, for example, a rectangular shape, which is located in parallel to an incident optical axis from the optical writing apparatus 58 to the image carrier 44. Also, this partition wall 118 constitutes developer paths 122*a* and 122*b* in connection with the developing apparatus unit main body 112 on both sides of this window portion 120. Both the developer paths 122*a* and 122*b* cause the first developer storage portion 116*a* to be communicated with the second developer storage portion 116*b*. In the first developer storage portion 1116*a*, a first stirring/transporting member 124 is rotatably arranged. This first stirring/transporting member 124 is constituted by such a wire member which is formed in a helical shape along different winding directions to each other. The first stirring/transporting member 124 supplies the developer stored in the first developer storage port 116a to the developer paths 122*a* and 122*b*. A second stirring/transporting member 126 is rotatably arranged at a lower position of the first stirring/transporting member 124 within the second developer storage unit 116*b*. This second stirring/transporting member 126 is constituted by a screw shaft formed along different directions from edge portions thereof (viewed along axial direction) toward a center portion thereof. Since the developer is uniformly dispersed by the second stirring/transporting member 124, the developer supplied from the developer paths 122*a* and 122*b* formed on the both sides may be transported along the center direction. As a consequence, as indicated by an arrow of FIG. 3, the developer which has been stored in the first developer storage unit 116*a* is transported to the both sides of the first stirring/transporting member 124 by this first stirring/transporting member 124, and then, is dropped via the developer paths 122*a* and 122*b* to the second developer storage unit 116*b*, and thereafter is uniformly dispersed by rotating the second stirring/transporting member 124, so that the dispersed developer is transported to the side of the developing roller 86.

Furthermore, both a third stirring/transporting member 128 and a fourth stirring/transporting member 130 are arranged in the second developer storage portion 116*b*. The third stirring/transporting member 128 transports the developer transported by the second stirring/transporting member 126 to the fourth stirring/transporting member 130. This fourth stirring/transporting member 130 is arranged at an output port of the second developing member storage portion 116*b*. The fourth stirring/transporting member 130 transports the developer which has been transported by the third stirring/transporting member 128 to the developing roller 86, and also, mixes this new developer with the deteriorated developer which has been scratched/dripped from the developing roller 86.

A layer thickness restricting member 134 made of, for instance, a resin is made in contact with the developing roller 86. A thickness of a developer layer adhered on the surface of the developing roller 86 is restricted by this layer thickness restricting member 134.

As previously explained, the latent image writing position "P" of the image carrier 44 is located at the position lower than the first developer storage portion 116*a*. Also, since the optical writing apparatus 58 is substantially horizontally arranged, the upper portion of the optical writing apparatus 58 is arranged in such a manner that this upper portion is overlapped with respect to the first developer storage portion 116*a* in the direction parallel to the optical axis of the light entered into the image carrier 44.

Next, operations of the above-described image forming apparatus according to this first embodiment mode will now be explained.

While the image carrier 44 is uniformly charged by the charging apparatus 56, light emitted from the optical writing apparatus 58 is irradiated onto this charged image carrier 44 in response to an image signal, and then, a latent image is formed at the latent image forming position "P" thereof. The light emitted from the optical writing apparatus 58 passes through the process cartridge 64 via the window portion 108 of the process cartridge 64. The latent image which has been formed on the image carrier 44 by this optical writing apparatus 58 is developed by the developer of the developing apparatus 60 so as to produce a visible image.

While the developer has been stored in both the first developer storage portion 116*a* and the second developer storage portion 116*b*, the developer stored in the first developer storage portion 116*a* is transported to both sides by rotating the first stirring/transporting member 124, and then both the developer located on the both sides is transported via the two developer paths 122*a* and 122*b* to the second developer storage unit 116*b*. Furthermore, the developer of the second developer storage portion 116*b* is uniformly dispersed by rotating the second stirring/transporting member 126, and then, the uniformly dispersed developer is transported to the developing unit 114 by the third stirring/ transporting member 128 and the fourth stirring/transporting member 130. In this developing unit 114, the transported developer is adhered onto the developing roller 86, the layer thickness of the adhered developer is restricted by the layer thickness restricting member 134, the thickness restricted developer is transported up to a developing position located opposite to the image carrier 44, and then, an image made of the developer is formed in correspondence with the latent image of the image carrier 44.

On the other hand, one of the paper supply units 18*a* to 18*d* is selected in response to a size signal and the like, recording mediums stored in one of these paper supply cassettes 22 are fed out by the feeding roller 24, and these recording mediums are smoothly separated by the retard roller 26 and the nudger roller 28 so as to conduct a recording medium to the transport path 32. Then, this conducted recording medium is temporarily stopped by the register roller 38, and thereafter, this recording medium is conducted between the transferring apparatus 42 and the image carrier 44 at proper timing.

When the recording medium is conducted between the transferring apparatus 42 and the image carrier 44 in this manner, the developer on the image carrier 44 is transferred to the recording medium by the transferring apparatus 42. This recording medium to which the developer has been transferred is penetrated through the fixing apparatus 36, and then is ejected from the ejection port 34 to the ejection unit 16.

The recording medium is penetrated through the transport path 32, and then is ejected to the ejection unit 16, and thus a so-called "C-path" is constituted, while this transport path 32 is formed along the substantially vertical direction from the paper supply units 18*a* to 18*d* arranged along the horizontal direction. In this embodiment mode, since the process cartridge 64 is stored within the C-path, the layout of this image forming apparatus can be made compact. However, if the developer storage space connected to the developing unit 114 is arranged lower than the latent image writing position "P" in the normal design manner, such a dead space is produced between the paper supply unit 18*a* and the optical writing apparatus 58. More specifically, in the case that a storage capacity of the developer is increased, since the space located lower than the latent image writing position "P" must be increased, a larger dead space is produced.

However, in this first embodiment mode, the window portion 120 which constitutes the scanning optical path from the optical writing apparatus 58 is formed in the process cartridge 64, and also, the developer paths 122*a* and 123*b* are formed on both sides of this window portion 120, so that the first developer storage portion 116*a* can be arranged above the scanning optical path. As a result, the position of the optical writing apparatus 58 can be lowered, and also, the space defined between the paper supply unit 18*a* and the optical writing apparatus 58 can be made small. In this case, although the space is produced between the ejection unit 16 and the optical writing apparatus 58, another optical writing apparatus 58 may be arranged in this space, so that a plurality of machine sorts of image forming apparatus may be manufactured while the main bodies of the image forming apparatus and the like are commonly used.

Figure 4:
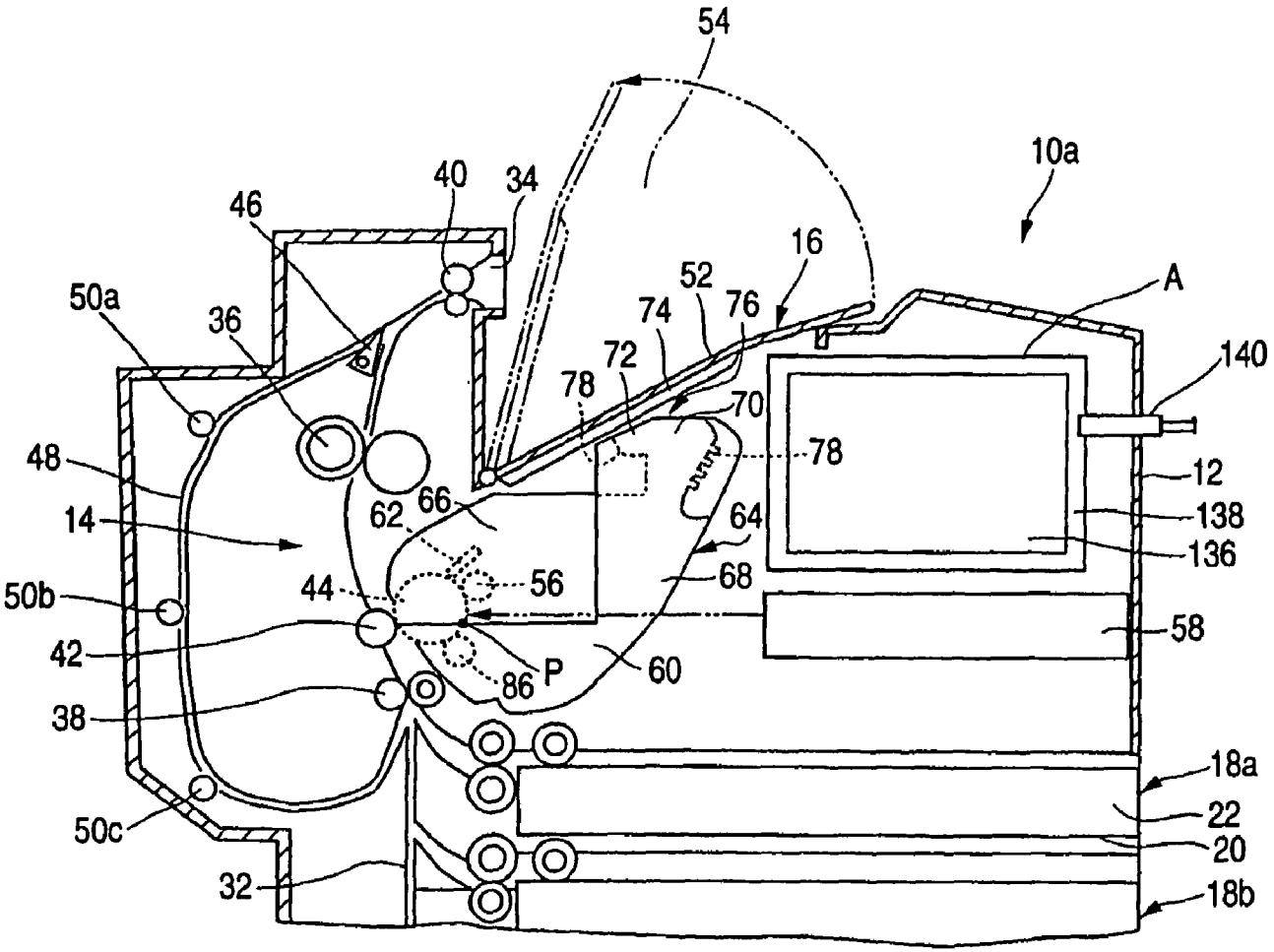
FIG. 4 is a side view for indicating a portion of an image forming apparatus according to a second embodiment mode of the present invention.

FIG. 4 indicates an image forming apparatus according to a second embodiment mode of the present invention. In this second embodiment mode, both a control board 136 and a network interface board 138 are stored in a space "A". A control circuit for controlling a drive system of the power supply units 18*a* to 18*d*, and also a drive system of the image forming section 14 is mounted on this control board 136. A circuit such as a router is mounted on the network interface board 138, and this circuit is used to connect the image forming apparatus via this network interface board 138 to a LAN (Local Area Network) and the Internet. This network interface board 138 owns a connector 140, and this connector 140 is arranged at a front surface portion of the image forming apparatus main body 12. As a consequence, since both the control board 136 and the network interface board 138 are arranged on the front surface of the image forming apparatus main body 12, users may easily access the boards, so that the maintenance characteristic thereof may be improved. Moreover, since the connector 140 for the network cable is arranged on the front surface of the image forming apparatus, the installation characteristic may be improved, and also the network cable may be readily connected.

It should be understood that both the control board 136 and the network interface board 138 are arranged in the space A in this second embodiment mode. Alternatively, any one of the control board 136 and the network interface board 138 may be arranged in the space A. Also, both the control board 136 and the network interface board 138 may be collectively mounted on a single board.

Figure 5:
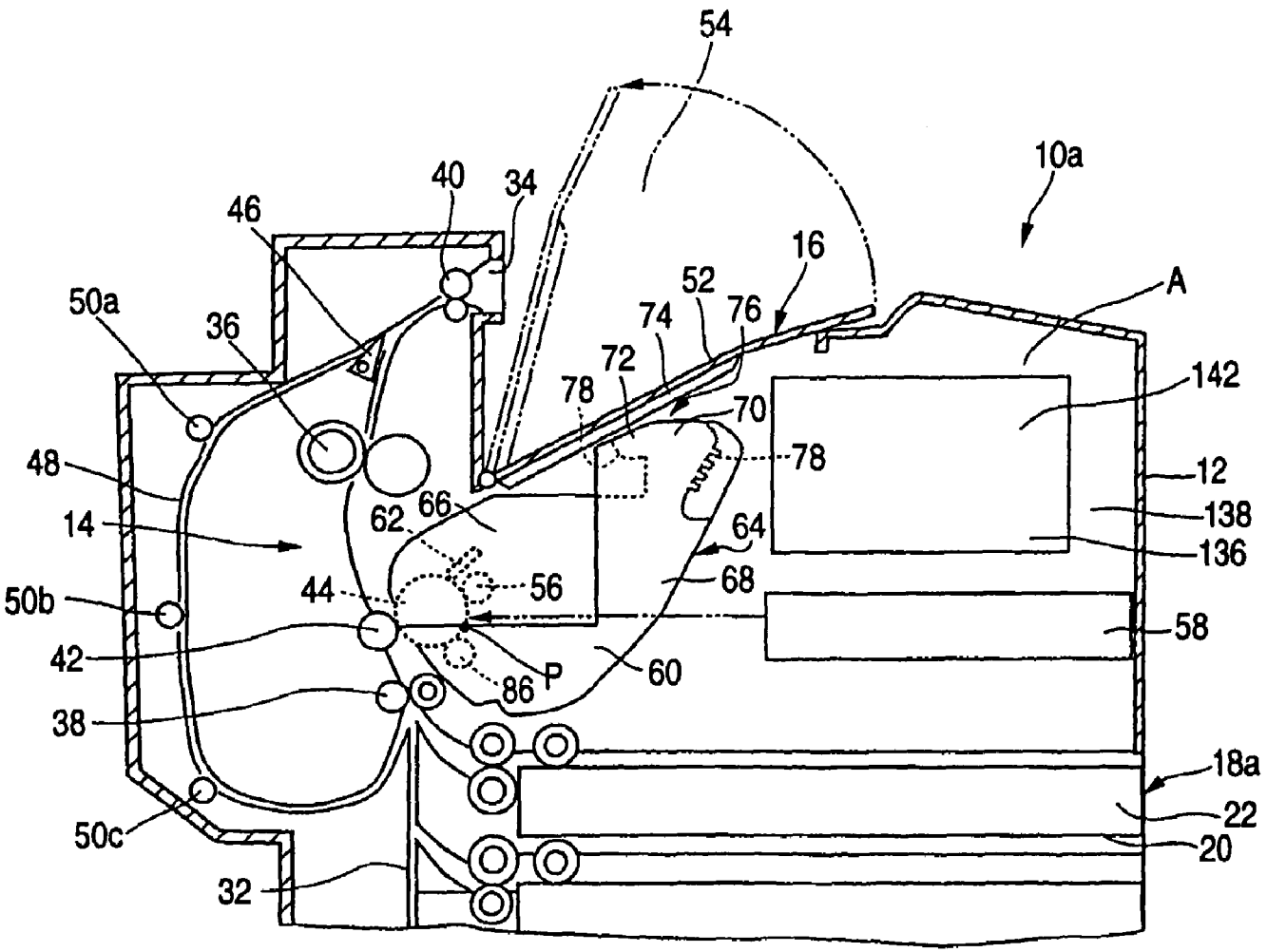
FIG. 5 is a sectional view for indicating a portion of an image forming apparatus according to a third embodiment mode of the present invention.
Figure 6:
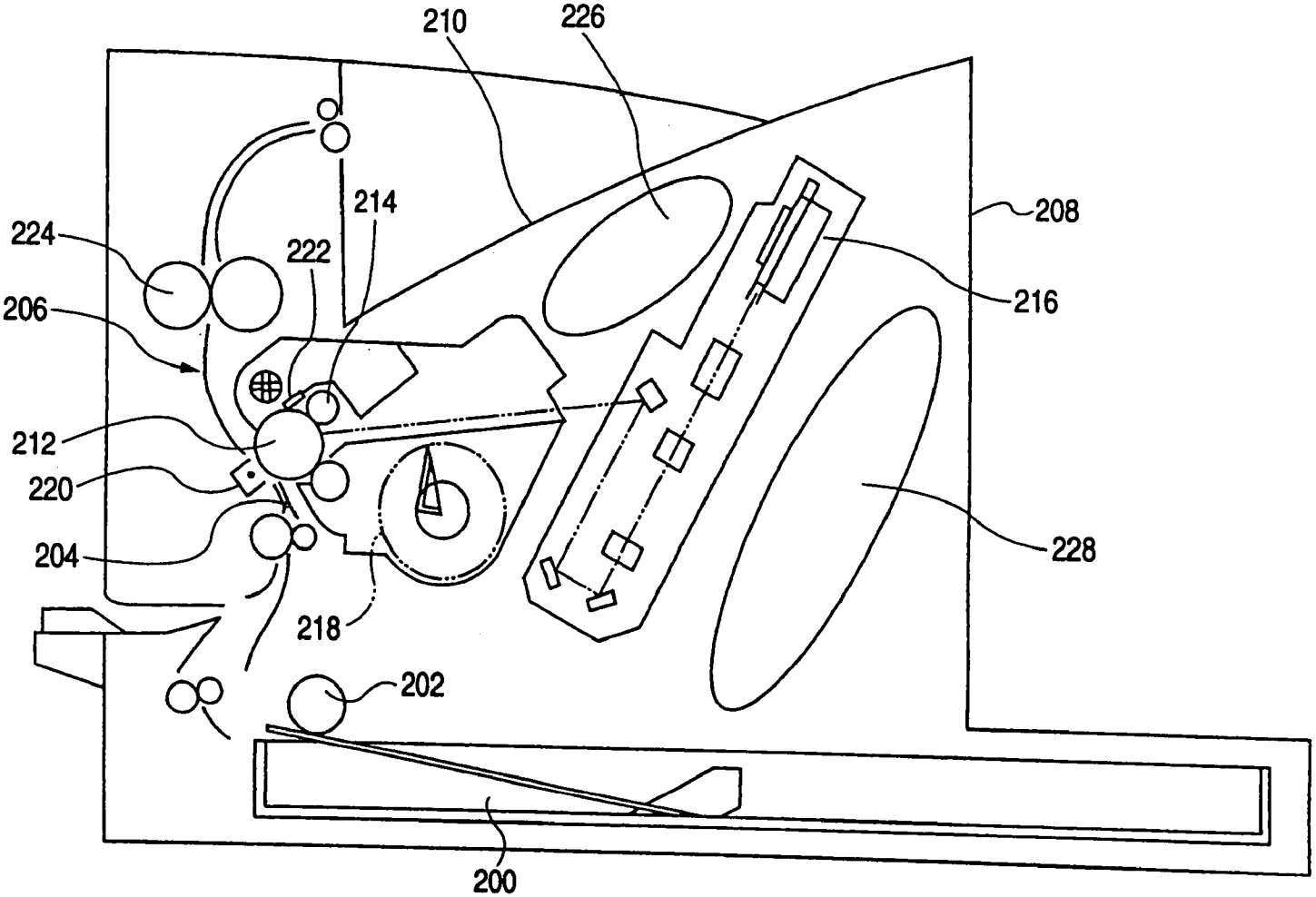
Fig. 6 RELATED ART
FIG. 6 is a sectional view for showing the conventional image forming apparatus.

FIG. 5 indicates an image forming apparatus according to a third embodiment mode of the present invention. In this third embodiment mode, a developer storage vessel 142 is arranged in a space "A". While developer is stored in this developer storage vessel 142, the developer storage vessel 142 is connected to the above-described first developer storage unit 116*a*, so that the developer can be supplied to the first developer storage portion 116a. In other words, this developer storage vessel 142 constitutes a third developer storage portion, and this developer storage vessel 142 is arranged in the case that a storage capacity of the developer is wanted to be increased. As previously described, since the space "A" is utilized as the developer storage portion, the storage capacity of the developer may be simply increased without changing other structural elements.

It should also be understood that the developer storage vessel 142 is constructed as a separate member with respect to the process cartridge 64 in this third embodiment mode. Alternatively, as another embodiment mode, the developer storage vessel 42 may be constituted by employing the process cartridge 64 in an integral form. Also, not only the developer storage vessel 142, but also the above-described control board and network interface board may be jointly stored in the space "A".

As previously described, in accordance with the present invention, since the latent image writing position is set to be lower than at least a portion of the developer storage space, the space defined between the optical writing apparatus and the paper supply unit can be made narrow, and also the production of the dead space can be suppressed. Also, the control board, the interface board, the developer storage vessel, and the like are arranged between the ejection unit and the optical writing apparatus, so that the space can be effectively utilized.

Figure 7:
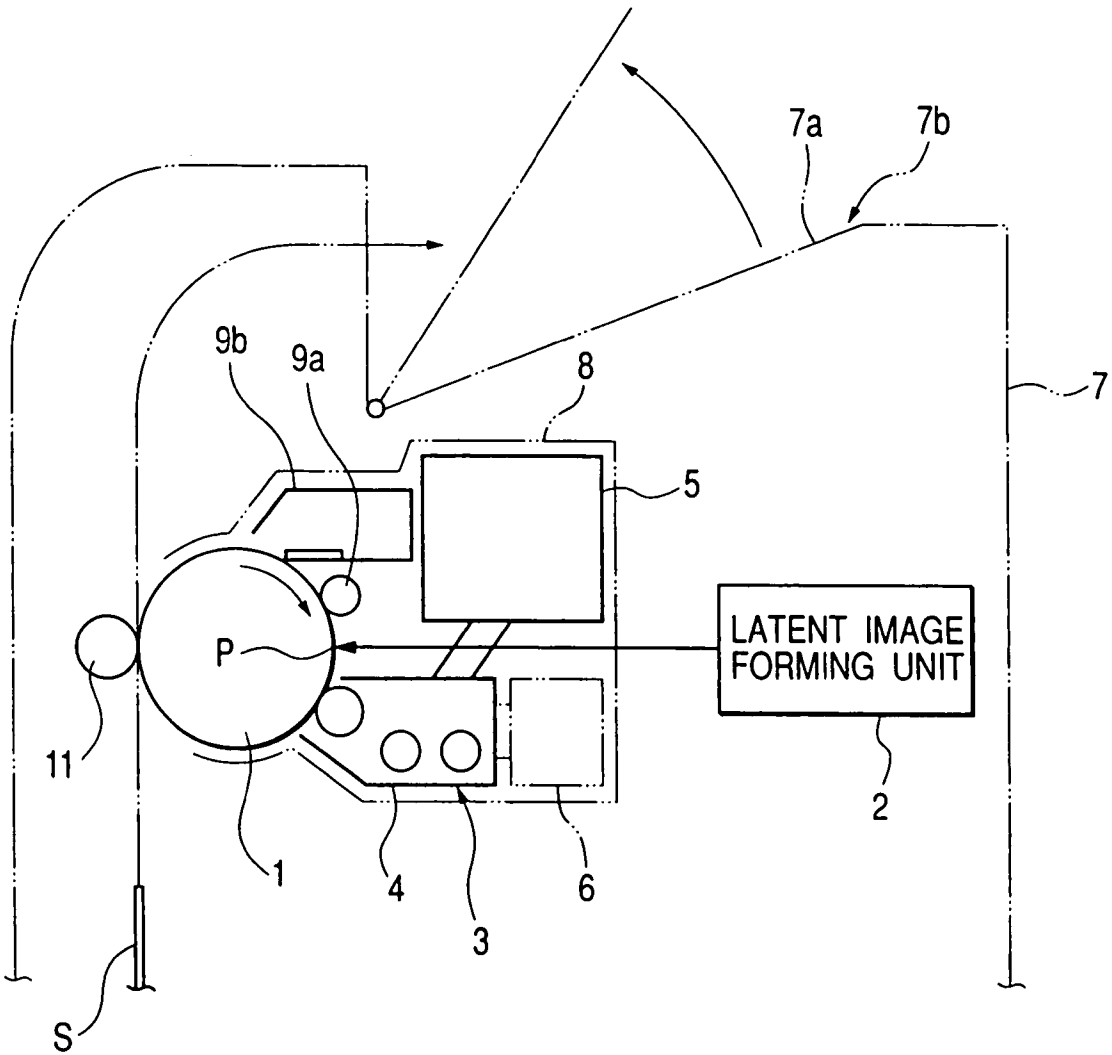
FIG. 7 is an explanatory diagram interrelatedly showing an image forming apparatus, a process cartridge, and a developing unit, which are based on the present invention.

According to the present invention, an image forming apparatus has a latent image forming unit 2 and a developing unit 3 as shown in FIG. 7. The latent image forming unit 2 forms a latent image on an image carrying body 1. The developing unit 3 visualizes the latent image formed on the image carrying body 1 by using a developer. For the developing unit 3, a developer replenishment box 5 is communicatively connected to a developing housing 4 in which a developer is contained. The developer replenishment box 5 is disposed in upstream of a latent image writing position P on the image carrying body 1.

It will be understood that the invention can be applied to every image forming apparatus of a type in which a latent image is visualized by the developing unit 3. The invention may be applied to not only the monochrome machine but also the color machine of the tandem type in which a plurality of image carrying bodies 1 are arrayed.

For the developing unit 3, any kind of developer may be used if it is capable of replenishing the developer. The developer may be any of a two-component developer, a one-component developer, and a developer in which magnetic carrier is used for only a carrier medium for transporting supplied toner and the like.

The developer replenishment box 5 involves a variety of containers each capable of replenishing a developer (toner, toner+carrier).

The reason why the latent image writing position P is used as a reference position is that if the developer replenishment box 5 blocks the latent image writing position, it is impossible to form a latent image on the image carrying body 1.

Further, the reason why the wording "upstream of the latent image writing position P" is used is to include sheet paths other than the substantially vertically extending sheet path (in the case of an S-shaped sheet path, for example, the sheet path substantially horizontally extending sheet path is frequent).

The reason why the developer replenishment box 5 is disposed in upstream of the latent image writing position P is that the function of replenishing the developer is realized while effectively utilizing the space within the apparatus, and it is easy to cope with a change of the developer replenishing amount.

Further, this type of image forming apparatus preferably includes a process cartridge 8, which is detachably attached to an apparatus body 7, and into which the image carrying body 1 and at least one process unit 9 (9*a*: charging unit, for example, 9*b*: cleaning unit 9*b*, for example) are incorporated. The developer replenishment box 5 is preferably installed to the process cartridge 8.

In the embodiment, the process cartridge 8 may be attached to and detached from the apparatus body 7, while containing the developer replenishment box 5.

The developer replenishment box 5 may be formed integrally with the process cartridge 8. However, it is preferable to detachably attach the developer replenishment box 5 to the process cartridge 8.

In this case, the developer replenishment box 5 may solely be replaced with another one, and the process cartridge 8 is effectively utilized.

It is also preferable that an image carrying body cartridge including at least the image carrying body 1 is detachably attached to the process cartridge 8.

In this case, the image carrying body cartridge may solely be replaced with another one, and the process cartridge 8 is effectively utilized.

Additionally, it is preferable that the process cartridge 8 may be attached to and detached from the apparatus body 7 from above, by opening an opening/closing cover 7*a* at the upper part of the apparatus body 7.

In this case, the attaching and detaching operations of the process cartridge 8 can be improved. To remove a recording sheet jammed near a transfer stage, user may access the jamming sheet by detaching the process cartridge 8. Thus, the opening/closing cover 7*a* is commonly used for both purposes of detaching the process cartridge 8 and removing the paper jam. As a result, the cost of the apparatus body 7 is reduced.

In a case where recovering of the waste developer is required, it is preferred that a waste developer recovering box 6 is integrally attached to the developer replenishment box 5.

The waste developer recovering box 6 involves a variety of containers for recovering the waste developer (which means mainly a deteriorated developer in the developing unit 3, but not exclusive of waste toner gathered after the cleaning).

According to the present invention, the replenishment of the developer and the recovering of the waste developer are simultaneously carried out (deteriorated developer, waste toner after the cleaning and the like) as well. In this case, there is no need of using an additional cartridge for collecting the waste developer, and the operability can be improved and the cost can be reduced.

The waste developer recovering box 6 is not provided separately from the developer replenishment box 5. Therefore, when the replenishing developer is used up and the developer replenishment box 5 is empty, the waste developer recovering box 6 is also replaced with another box forcibly. Accordingly, if design is made taking the volumes of the developer replenishment box 5 and the waste developer recovering box 6 into account, there is no need of detecting as to whether the waste developer recovering box 6 is full with the waste developer.

Even if the image forming apparatus includes any sheet path, no problem arises. In an image forming apparatus of a type in which a recording sheet S receiving a visual image from the image carrying body 1 by a transfer member 11 is transported from a lower part to an upper part, the developer replenishment box 5 may be disposed on the upper side of the latent image writing position P on the image carrying body 1.

In this case, since the developer replenishment box 5 is disposed in an upper part of the latent image writing position P, a freedom of the layout of the developer replenishment box 5 (it is easy to cope with the increase of the box volume) is increased. In this respect, it is preferable to dispose the developer replenishment box 5 so.

In an image forming apparatus of a type in which the waste developer recovering box 6 is attached to the developer replenishment box 5, the waste developer recovering box 6 may be attached to a desired position. For example, in the case of the waste developer recovering box 6 communicatively connected to the developing housing 4, it is preferable to dispose the waste developer recovering box 6 on the lower side of the latent image writing position P of the image carrying body 1.

Further, in an image forming apparatus of as type which includes a sheet path extending in a substantially vertical direction, a discharge tray 7*b* in which discharged sheets are contained is preferably provided on the upper side of the developer replenishment box 5.

In this case, the dead space under the discharge tray 7*b* may be effectively utilized for a space in which the developer replenishment box 5 is installed.

According to the invention, the upper surface housing of the developer replenishment box 5 is preferably a surface inclined in the same direction as of the discharge tray 7*b* in which the recording sheets S are contained.

According to the invention, a freedom of the layout of the developer replenishment box 5 is increased (it is easy to cope with the increase of the box volume), and realizing the size reduction of the image forming apparatus is realized by minimizing the dead space under the discharge tray 7*b*.

It is preferable that the developer replenishment box 5 is capable of containing a larger amount of developer than the developing housing 4 disposed on the lower side of the latent image writing position P on the image carrying body 1.

According to the invention, a freedom of the layout of the developer replenishment box 5 is increased (it is easy to cope with the increase of the box volume).

In an image forming apparatus which is provided with the sheet path extending in the substantially vertical direction, when the developer replenishment box 5 and the developing housing 4 are separately laid out to sandwich the latent image writing position P on the image carrying body 1 therebetween, the developer replenishment box 5 is disposed in an upper part of the latent image writing position P on the image carrying body 1, and the developing housing 4 is disposed in a lower part of the latent image writing position P. It is preferable that the developer replenishment box 5 is communicatively connected to the developing housing 4 by way of a communicative passage, which makes a detour around the latent image writing position P.

The embodiment effectively utilizes the space within the machine, reduces the size of the developing unit 3, and realizes the developer replenishment.

In an image forming apparatus of the type in which the sheet path is substantially vertically directed, and an intermediate transfer member is used, an image forming apparatus has a latent image forming unit 2, a developing unit 3, and an intermediate transfer member (not shown). The latent image forming unit 2 forms a latent image on an image carrying body 1. The developing unit 3 visualizes the latent image formed on the image carrying body 1 by using a developer. The intermediate transfer member temporarily holds the visual image formed on the image carrying body 1, and transfers the visual image onto a recording sheet S. The recording sheet S is transported from a lower part to an upper part.

In this case, for the developing unit 3, a developer replenishment box 5 is communicatively connected to a developing housing 4 in which a developer is contained, and the developing housing 4 and the developer replenishment box 5 are disposed in an upper part of a latent image writing position P on the image carrying body 1. According to the invention, a space under the latent image writing position P on the image carrying body 1 is minimized, and hence the vertical size of the apparatus is reduced.

The intermediate transfer member used is required for enabling the transferring of the visual image to the recording sheet S moving in the substantially vertical direction.

The present invention is not limited to the image forming apparatus mentioned above, but may be applied to the single units i.e., the process cartridge 8 and the developing unit 3, which are used in the image forming apparatus, as shown in FIG. 7.

Preferred embodiments of the present invention will be described in detail with reference to the accompanying drawings.

Figure 8:
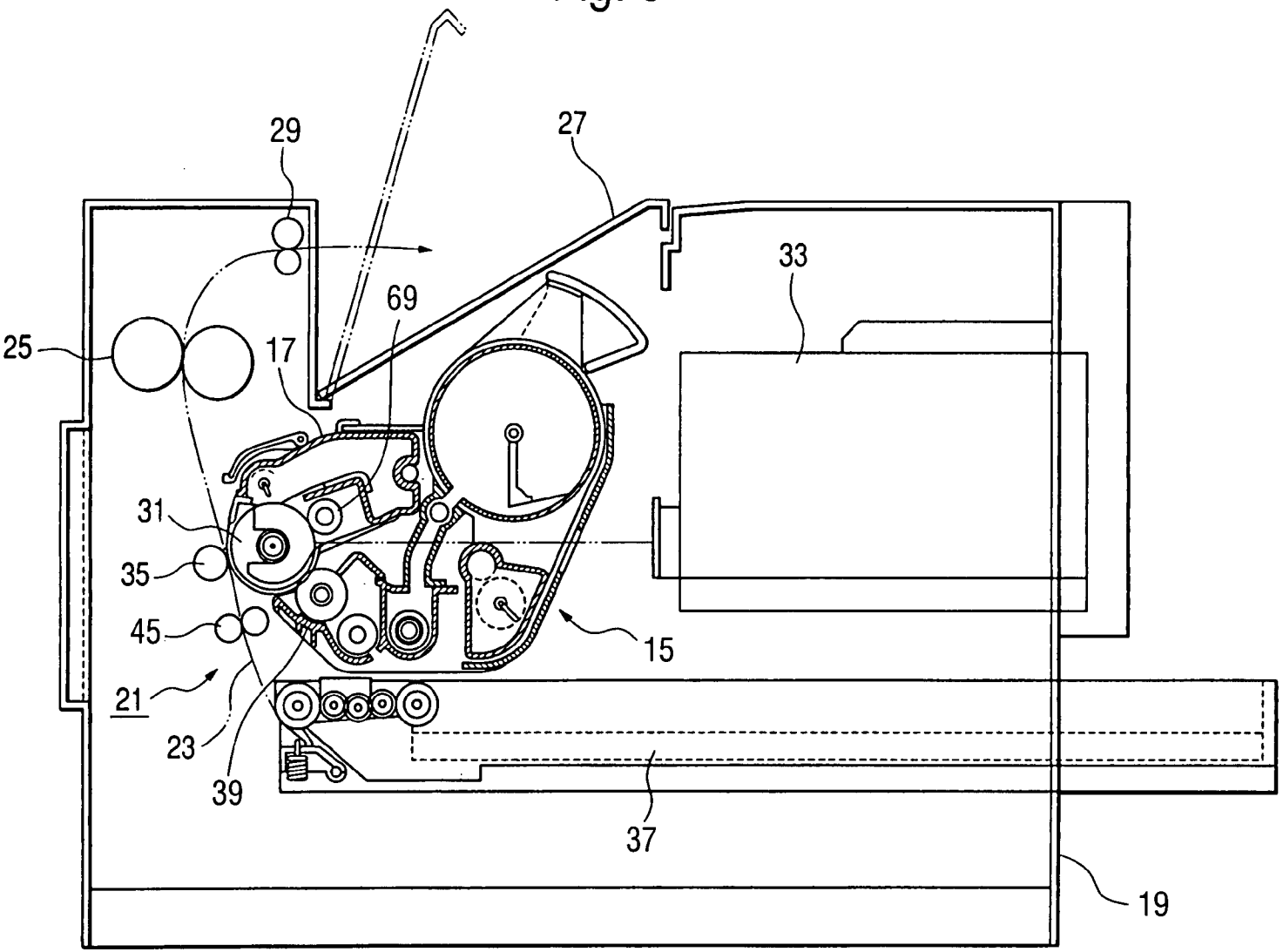
FIG. 8 is an explanatory diagram for explaining an overall construction of an image forming apparatus which forms an embodiment of the invention.

FIG. 8 is an explanatory diagram for explaining an embodiment 1 of an image forming apparatus according to the present invention.

In the figure, the image forming apparatus includes an image forming engine 21, for example, employing an electrophotography system, a sheet supply unit 37, a discharge tray 27, and a sheet transporting path 23. The image forming engine 21 is installed in an apparatus body 19. The sheet supply unit 37 is disposed under the image forming engine 21 in the apparatus body 19. An upper part of the apparatus body 19 is formed as the discharge tray 27. The sheet transporting path 23 is disposed in a rear part (a left side in FIG. 8) in the apparatus body 19 and substantially extends in a vertical direction. The sheet transporting path 23 leads a recording sheet S, which comes from the sheet supply unit 37, to the image forming engine 21 and the discharge tray 27.

In the instant embodiment, the image forming engine 21 is based on the electrophotography system, for example. The image forming engine 21 includes a photosensitive drum 31, a charging unit 69 (charging roll in this instance), an exposure unit 33, a developing unit 39, a transfer unit 35, and a cleaning unit 17. The charging unit 69 charges the photosensitive drum 31. The exposure unit 33 such as a laser scanning device writes an electrostatic latent image (hereinafter referred to as a latent image) on the charged photosensitive drum 31. The developing unit 39 develops the latent image on the photosensitive drum 31 by using toner. The transfer unit (transfer roll in this instance) 35 transfers a visual image (toner image) formed on the photosensitive drum 31 onto the recording sheet S. The cleaning unit 17 removes toner left on the photosensitive drum 31 to clean the photosensitive drum 31.

A register roller 45 for positioning the recording sheet S is provided in an upstream of the photosensitive drum 31 on the sheet transporting path 23. A fixing unit 25 is disposed in a downstream of the photosensitive drum 31 on the sheet transporting path 23. A discharge roll 29 is provided immediately before a discharge tray 27.

In the embodiment, most of devices of the image forming engine 21 are incorporated into a process cartridge 15.

Figure 9:
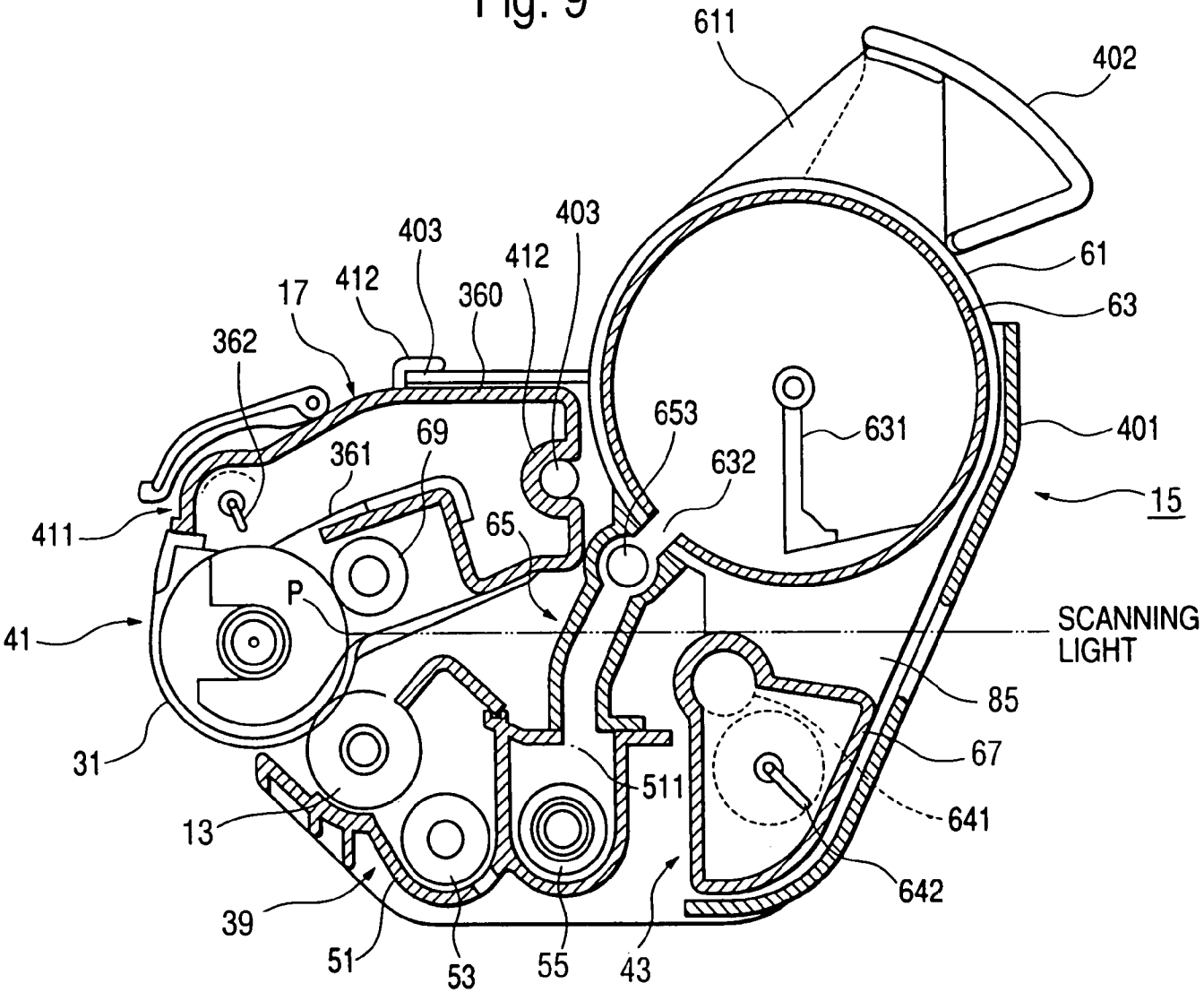
FIG. 9 is an explanatory diagram for explaining the details of a process cartridge used in the embodiment.

Specifically, the process cartridge 15 used in the instant embodiment, as shown in FIGS. 8 and 9, contains the photosensitive drum 31, charging unit 69, developing unit 39 and cleaning unit 17. The process cartridge 15 is detachably attached to the apparatus body 19. That is, the process cartridge 15 is constructed as so called CRU (customer replaceable unit).

In the instant embodiment, the photosensitive drum 31, charging unit 69 and cleaning unit 17 integrally form a photosensitive cartridge 41. The photosensitive cartridge is detachably attached to the process cartridge 15.

In the photosensitive cartridge 41, the charging unit 69 is disposed in an upstream (on the upper side in this instance) of the latent image writing position P on the photosensitive drum 31. Further, the cleaning unit 17 is disposed in the further upstream thereof.

In the instant embodiment, in the cleaning unit 17, a part of the cartridge case 411 is formed as a cleaning case 360. The cleaning unit 17 includes a cleaning blade 361, which is provided at an opening edge of the cleaning case 360 and in contact with the photosensitive drum 31, and a transporting paddle 362, provided near the opening of the cleaning case 360, for transporting toner left after the cleaning by the cleaning blade 361 to the inner part of the cleaning case 360.

Figure 10:
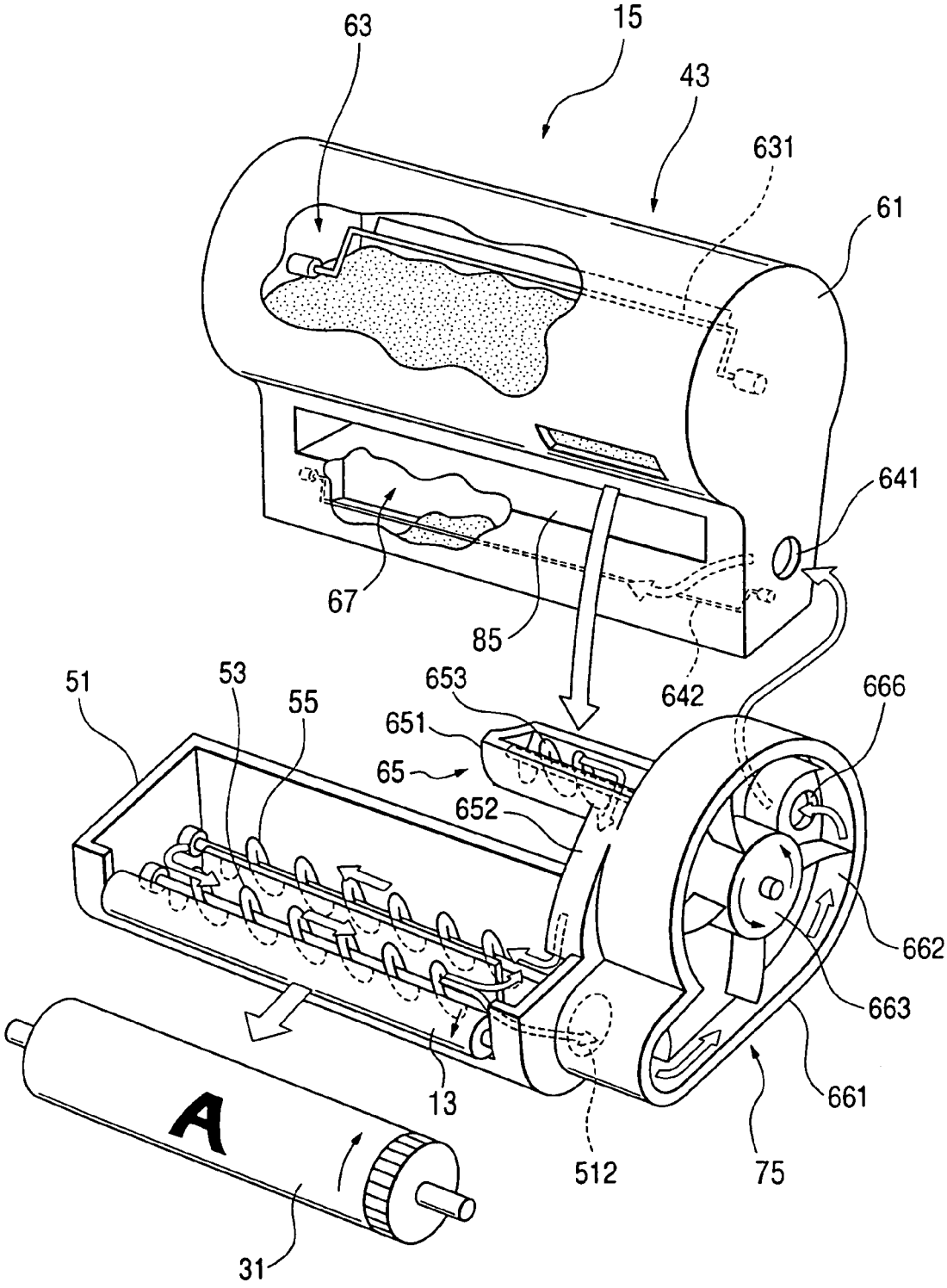
FIG. 10 is an exploded perspective view showing a major portion of the process cartridge including a waste developer transporting mechanism.

The developing unit 39 is based on the two-component development. As shown in FIGS. 9 and 10, the developing unit includes a developing housing 51 which is located in the downstream (on the lower side in this instance) of the latent image writing position P of the photosensitive drum 31 and opened to the photosensitive drum 31 side. A developing roll 13 is disposed facing the opening of the developing housing 51. A pair of agitating/transporting augers 53 and 55 by which the developer is agitated and transported are provided on the rear side of the developing roll 13. The developer agitated and transferred by the agitating/transporting augers 53 and 55 is transferred to the developing roll 13. A developer layer on the developing roll 13 is regulated in thickness by a trimming member (not shown), and the developer is supplied to a developing position on the photosensitive drum 31.

Further, the developing unit 39 includes a toner cartridge 43, which is located on the rear side of the developing housing 51.

The toner cartridge 43, as shown in FIGS. 9 and 10, is vertically extended astride the latent image writing position P on the photosensitive drum 31. A scanning passage 85 along which scanning light beam emitted from the exposure unit 33 passes is formed at a location of the cartridge case 61, which corresponds to the latent image writing position P. A toner replenishment box 63 is disposed in the upstream (on the upper side in this instance) of the latent image writing position P in the cartridge case 61. A waste developer recovering box 67 is disposed in the downstream(on the lower side in the instance) of the latent image writing position P.

In the instant embodiment, the toner replenishment box 63 is a cylindrical box extending in the axial direction of the developing roll 13. A toner agitator 631 is disposed within this, and agitates and mixes toner so as to prevent the toner from being clustered.

A toner replenishment duct 65 is communicatively connected between the toner replenishment box 63 and the developing housing 51. The toner replenishment duct 65 is positioned out of the scanning passage 85 so as not to interrupt the scanning passage 85.

The toner replenishment duct 65 includes a toner receiving part 651, which correspond to an elongated replenishment port 632 bored in a part of the toner replenishment box 63. The toner replenishment duct includes a connection pipe portion 652, which is communicatively connected from the outer side end of the toner receiving part 651 (as longitudinally viewed) to a replenishment port 511 of the developing housing 51 (which is located at a position which is lower than the replenishment port 632 of the toner replenishment box 63). A dispense auger 653 for supplying the received toner to the connection pipe portion 652 at a rate of a predetermined amount of toner is disposed within the toner receiving part 651.

In the present embodiment, the waste developer recovering box 67 is a box having a deformed fan-shape in cross section, which extends in the axial direction of the developing roll 13. A recovering port 641 is formed at an upper part of the side end of the waste developer recovering box, and a smooth agitator 642 for smoothing the collected waste developer is disposed within the waste developer recovering box.

A discharge port 512 for discharging the waste developer out of the developing housing 51 (the discharge port 512 is located at a position which is lower than the recovering port 641) is bored at one side end of the developing housing 51 as longitudinally viewed. The deteriorated developer is periodically discharged from the developing housing 51, through the discharge port 512.

One or a plurality of discharge ports 512 may be formed at a predetermined height in a normally open state. If required, a shutter, which is opened and closed at appropriate timings, may additionally be provided in association with the discharge port.

A waste developer transporting mechanism 75 is provided between the recovering port 641 of the waste developer recovering box 67 and the discharge port 512 of the developing housing 51.

Figure 11:
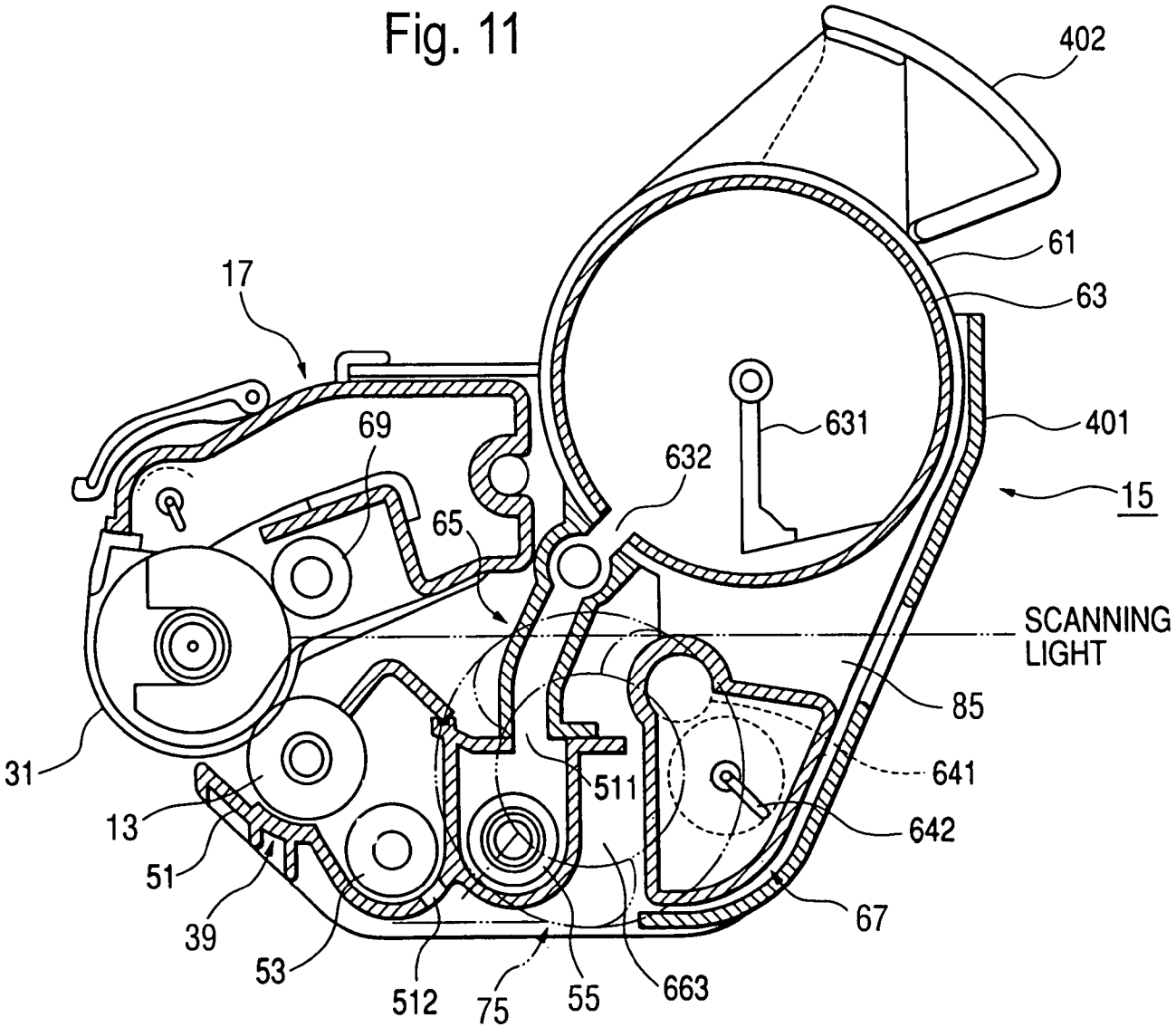
FIG. 11 is an explanatory diagram for explaining the details of the process cartridge including a waste developer transporting mechanism.
Figure 12A:
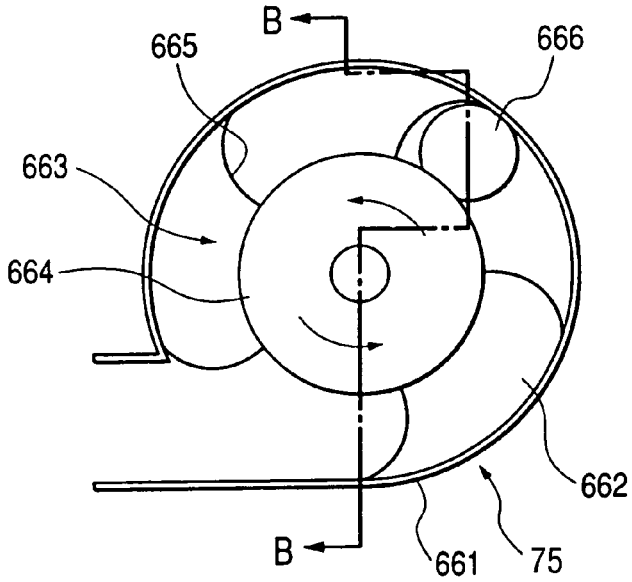
FIG. 12A is an explanatory diagram for explaining the waste developer transporting mechanism.
Figure 12B:
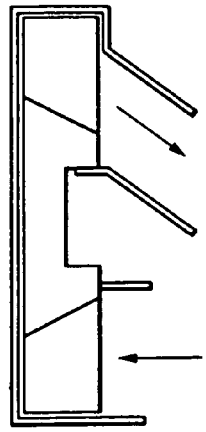
FIG. 12B is a cross sectional view taken on line B—B in FIG. 12A.

The waste developer transporting mechanism 75, as shown in FIGS. 10 to 12, is disposed on the side of the developing housing 51 and the toner cartridge 43. The recovering port 641 of the waste developer recovering box 67 and the discharge port 512 of the developing housing 51 are interconnected by a connecting duct 661 in a sealing fashion. A part of the connecting duct 661 forms a ring-like space part 662, and a recovering fin 663 is disposed within the ring-like space part 662.

In the recovering fin 663, a plurality of fin members 665 are disposed around the rotor 664 at predetermined angular intervals. The recovering port 641 is disposed at a position of the connecting duct 661 defining the ring-like space part 662, which the position faces a fin moving locus of the recovering fin 663. A communicating port 666 is bored at a part corresponding to the recovering port 641. If the recovering fin 663 is manufactured by resin molding or the like, the cost of it may be reduced.

In the embodiment, the process cartridge 15, as shown in FIG. 9, for example, includes each photosensitive cartridge 41, toner cartridge 43, and a cartridge holder 401 for holding another device. A movable holder 402 for holding down the toner cartridge 43 is provided in the cartridge holder 401 in a swingable manner. By removing an engaging state of the movable holder 402 with an engaging piece 611 of the toner cartridge 43, the toner cartridge 43 is separated from the cartridge holder 401. In FIG. 10, the engaging piece 611 of the toner cartridge 43 is not illustrated.

The process cartridge 15 is provided with a drive force transmitting system 71.

Figure 13:
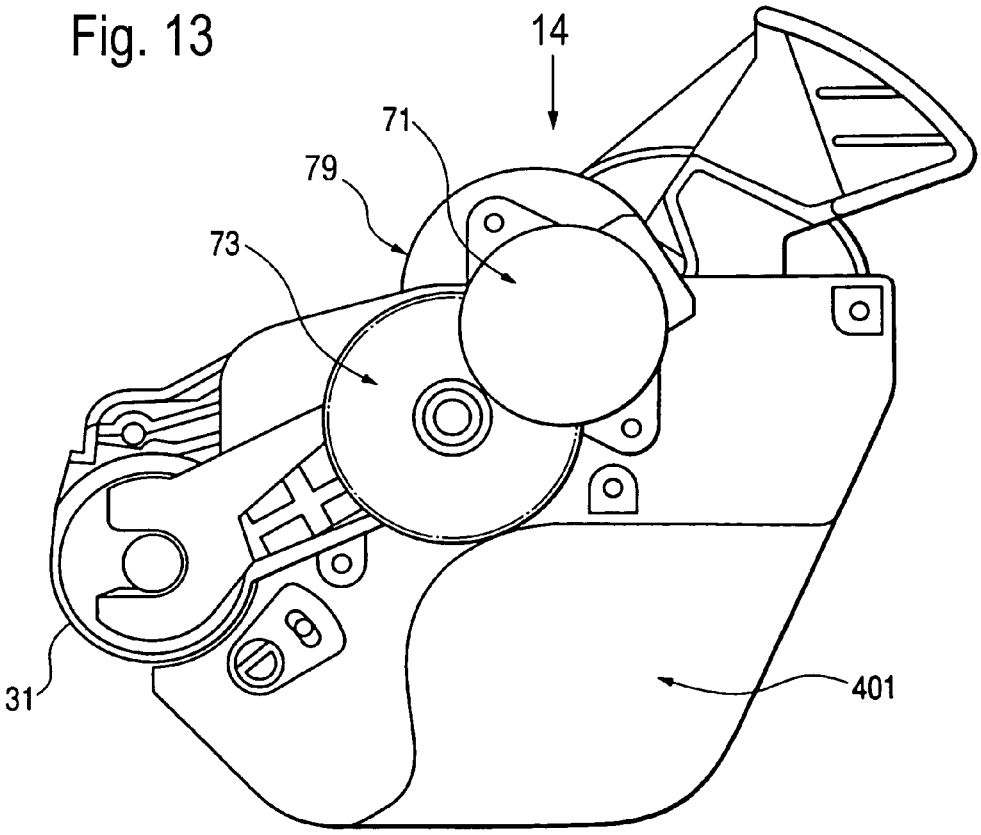
FIG. 13 is an explanatory diagram for explaining a drive force transmitting system of the process cartridge.
Figure 14:
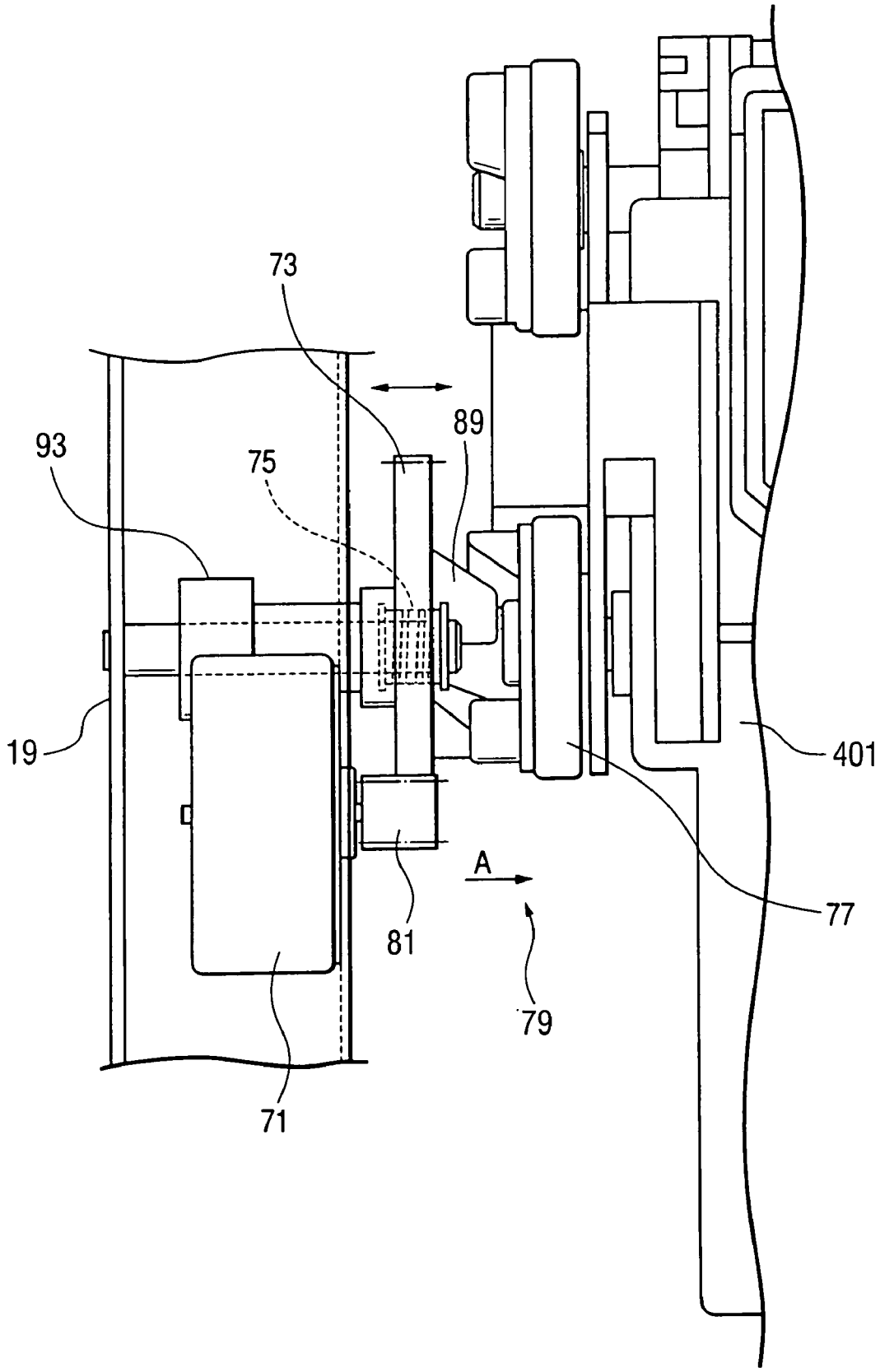
FIG. 14 is a view taken in an arrow direction VIII in FIG. 13.

In the drive force transmitting system 71, as shown in FIGS. 13 and 14, a drive motor 71 is fastened to the apparatus body 19. A drive coupling gear 73, which is in mesh with a drive shaft gear 81 of the drive motor 71, is provided with a drive side coupling 89. The developing unit 3 is axially movably supported with respect to the apparatus body 19. The drive coupling gear 73 is urged, by an urging spring 75, in such a direction as to move the drive coupling gear apart from the process cartridge 15. The drive shaft gear 81 and the drive coupling gear 73 are both helical gears. A torque limiter 93 is attached to the shaft of the drive coupling gear 73.

The cartridge holder 401 of the process cartridge 15 includes a CRU side coupling 77, which is removably coupled with the drive side coupling 89.

In the embodiment, the drive force transmitting system 71 operates in the following manner.

When the drive motor 71 is rotated in a predetermined direction, and its rotational force is transmitted, a thrust force having an arrow direction A is generated at a part where the drive shaft gear 81 is in mesh with the drive coupling gear 73, by the rotational direction of the motor and the load of the torque limiter 93. By the thrust force, the drive side coupling 89 is coupled with the CRU side coupling 77, while resisting the urging force by the urging spring 75.

When the drive motor 71 stops, the thrust force disappears at the meshing part between the drive shaft gear 81 and the drive coupling gear 73. As a result, the drive side coupling 89 retracts by the urging force of the urging spring 75, and the drive side coupling 89 is decoupled from the CRU side coupling 77.

To decouple those couplings one from the other, the drive motor 71 is rotated in the direction opposite to the direction in which the motor is rotated when those couplings are coupled. As a result, a thrust force of which is opposite in direction to the thrust force generated when those couplings are coupled is generated at the meshing part between the drive shaft gear 81 and the drive coupling gear 73. In this way, those may be decoupled one from the other.

Where such a coupling removal mechanism is employed, there is no need of using additional parts exclusively used for the decoupling of the couplings. Accordingly, the coupling removal mechanism is simplified correspondingly.

An operation of the thus constructed image forming apparatus which is the embodiment of the invention, will be described.

As shown in FIG. 8, in the process cartridge 15, the photosensitive drum 31 is charged by the charging unit 69, and after a latent image is formed on the photosensitive drum 31 by the exposure unit 33, and it is visualized (into a toner image) by the developing unit 39.

A recording sheet is fed to the sheet transporting path 23 at a predetermined timing, from the sheet supply unit 37, and it is positioned by the register roller 45 and then to a transfer stage.

The toner image is transferred from the photosensitive drum 31 onto the recording sheet by the transfer unit 35, and the toner image, not yet fixed, is fused and fixed on the recording sheet by the fixing unit 25, and the sheet having undergone the fixing process is discharged into the discharge tray 27. The residual toner on the photosensitive drum 31 is removed by the cleaning unit 17.

During such an image forming process, a scanning light beam emitted from the exposure unit 33 reaches the latent image writing position P on the photosensitive drum 31, through the scanning passage 85 of the process cartridge 15. Therefore, there is no chance that the process cartridge 15 impairs the exposure scanning performance of the exposure unit 33.

In the developing unit 39, as the image forming process progresses, the amount of toner consumption increases, and new tone is successively replenished from the toner replenishment box 63 to the developing housing 51 by way of the toner replenishment duct 65 in accordance with an algorithm of toner replenishment control unit, not shown.

The new toner replenished into the developing housing 51, and the developer in the developing housing 51 is agitated and mixed together by the agitating/transporting augers 53 and 55. The thus mixed one is supplied to the developing roll 13, while retaining a predetermined charging characteristic. The developer held by the developing roll 13 is supplied to the developing area associated with the photosensitive drum 31.

In the developing unit 39, part of the developer in the developing housing 51 is not used for the development, and circulated within the developing housing 51 by the agitating/transporting augers 53 and 55.

Such an developer has been deteriorated and it is difficult for the developer to retain the charging characteristic. In the embodiment, the waste developer (mainly deteriorated developer) is discharged from the discharge port 512 of the developing housing 51 periodically or predetermined timings.

The waste developer, as shown in FIGS. 10 and 11, is transported into the recovering fin 663 in the waste developer transporting mechanism 75, and dropped into and collected by the waste developer recovering box 67 through the recovering port 641 of the waste developer recovering box 67, and is agitated by the smooth agitator 642.

Figure 15:
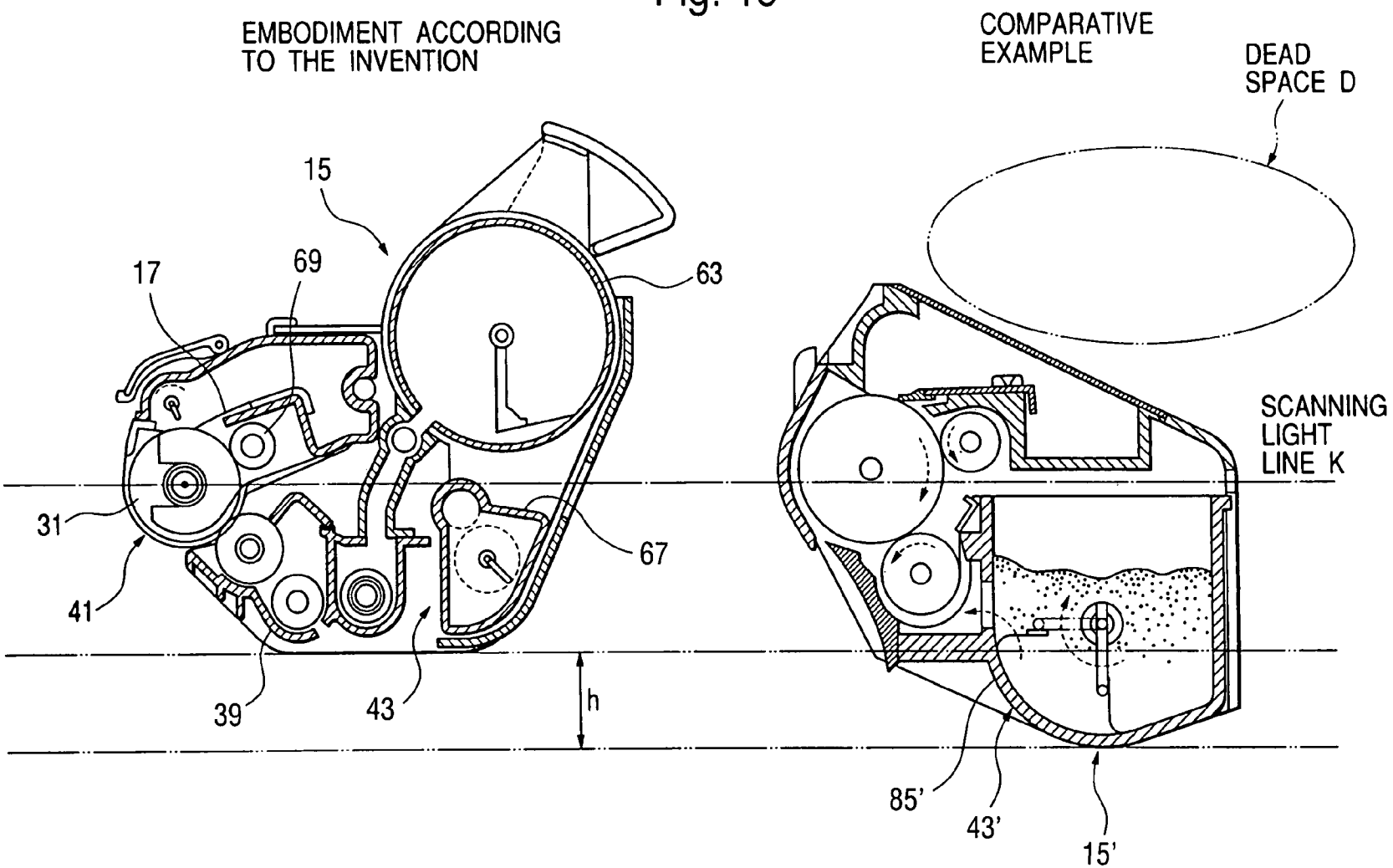
FIG. 15 is a diagram comparatively showing a layout inclusive of the process cartridge in the embodiment and a layout inclusive of the process cartridge, which is illustrated for comparative purpose.

A layout of the process cartridge 15 within the apparatus body 19 is shown in FIG. 15.

A comparative example used here is a process cartridge 15' incorporating thereinto a toner cartridge 43' (equipped with only a toner replenishment box 63 in this instance), which is located downstream (on the lower side in this instance) of the latent image writing position P on the photosensitive drum 31.

The process cartridge 15 of the embodiment is compared with the process cartridge 15' of the comparative example. The bottom of the process cartridge 15 of the instant embodiment is higher than that of the comparative example by "h". With this feature, there is eliminated a layout limit imposed onto the sheet supply unit 37 and the like, which are disposed in a lower part of the apparatus body 19.

In the embodiment, the toner replenishment box 63 is disposed upstream (on the upper side in this instance) of the latent image writing position P on the photosensitive drum 31. Therefore, a space occupied by the process cartridge in an upper part of the scanning light line "k" in the apparatus body 19 is increased and larger than that in the comparative example.

As recalled, in the comparative example, the space in the lower part of the discharge tray 27 within the apparatus body 19 is the dead space D. The instant embodiment effectively utilizes this dead space D, and uses it merely as a space occupied by the toner replenishment box 63. Therefore, when the process cartridge 15 of the embodiment is used, there is no need of greatly changing the specifications on the upper part of the apparatus body 19.

Even in such a case of increasing the toner replenishing amount of the toner replenishment box 63, if the space of the upper part within the apparatus body 19 is effectively used, it is required to little change the specifications on the upper part (vicinal region around the discharge tray 27),of the apparatus body 19.

For this reason, in constructing the image forming apparatuses of various specifications, the apparatus body 19 may be used in common for those different image forming apparatuses.

Even in a case where the upper part specifications of the apparatus body 19 are unavoidably changed, such a minute change of the specifications as somewhat raising of the discharge tray 27, suffices. As in the comparative example where the space in the lower part of the apparatus body 19 is limited, the specification must greatly be changed, for example, the layout in the sheet supply unit 37 is changed. In the instant embodiment, by contrast, there is no need of greatly changing the specifications.

The attaching and detaching operations of the process cartridge 15, which is constructed according to the invention, will be described hereunder.

In the embodiment, a cartridge receiving part 87 to and from which the process cartridge 15 is attached and detached is provided within the apparatus body 19. The cartridge receiving part 87 is provided with a guide part 81 which consists of, for example, a groove. A guided part of the cartridge holder 401 of the process cartridge 15 slidably engages the groove.

Also in the embodiment, a part of the bottom wall of the discharge tray 27 is formed as an opening/closing cover 82. An opening formed when the opening/closing cover 82 is opened, is used as a work opening 83, which is used for the attaching and detaching operations of the process cartridge 15.

Figure 16:
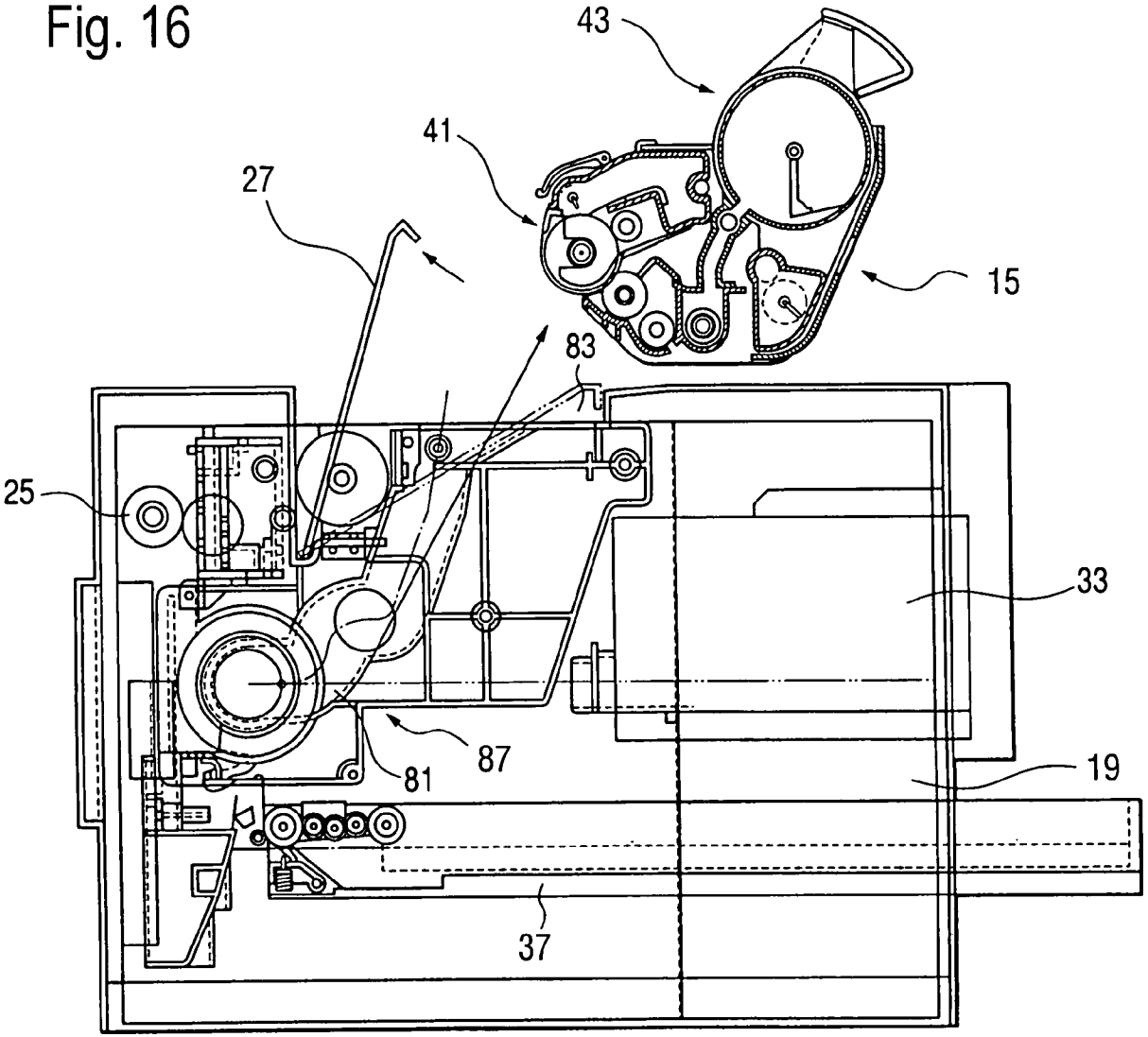
FIG. 16 is an explanatory diagram for exemplarily explaining the attaching/detaching of the process cartridge constructed according to the embodiment.

To pulled out the process cartridge 15 from the apparatus body 19, as shown in FIG. 16, for example, the opening/closing cover 82 is opened, and one pulls out the process cartridge 15 from the cartridge receiving part 87 of the apparatus body 19, through the work opening 83.

Figure 17:
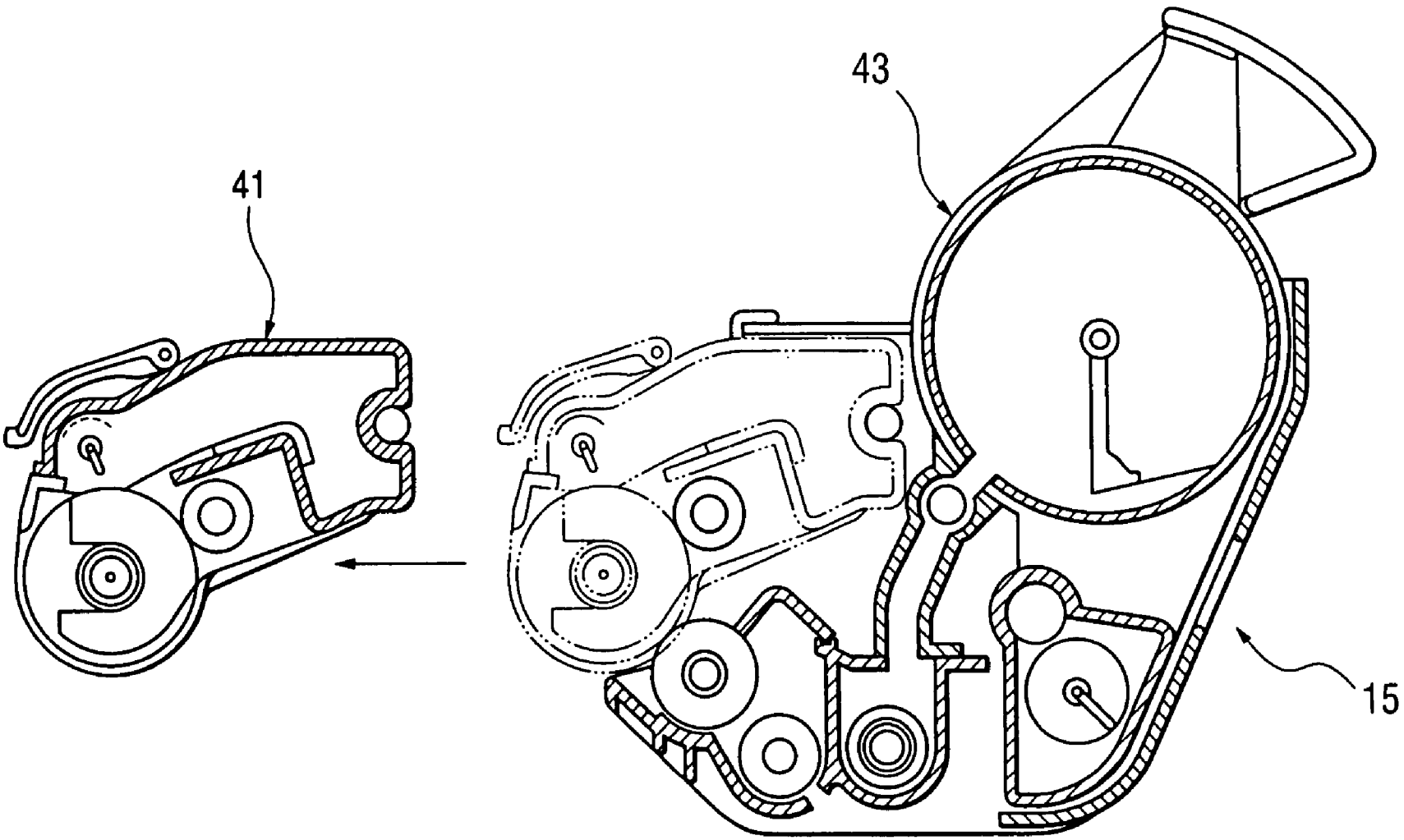
FIG. 17 is an explanatory diagram for explaining a relationship between the process cartridge and a photosensitive cartridge.

In this state, when the photosensitive cartridge 41, for example, is replaced with another cartridge, one removes the photosensitive cartridge 41 from the process cartridge 15 as shown in FIG. 17.

As shown in FIG. 9, the cartridge case 411 of the photosensitive cartridge 41 includes an engaging part 412, which may engage with and disengage from engaged parts 403 in the cartridge holder 401. With the aid of the engaging part, the cartridge case is positioned to and detachably attached to the cartridge holder 401.

In the embodiment, the toner cartridge 43 may be detached from the process cartridge 15.

Figure 18:
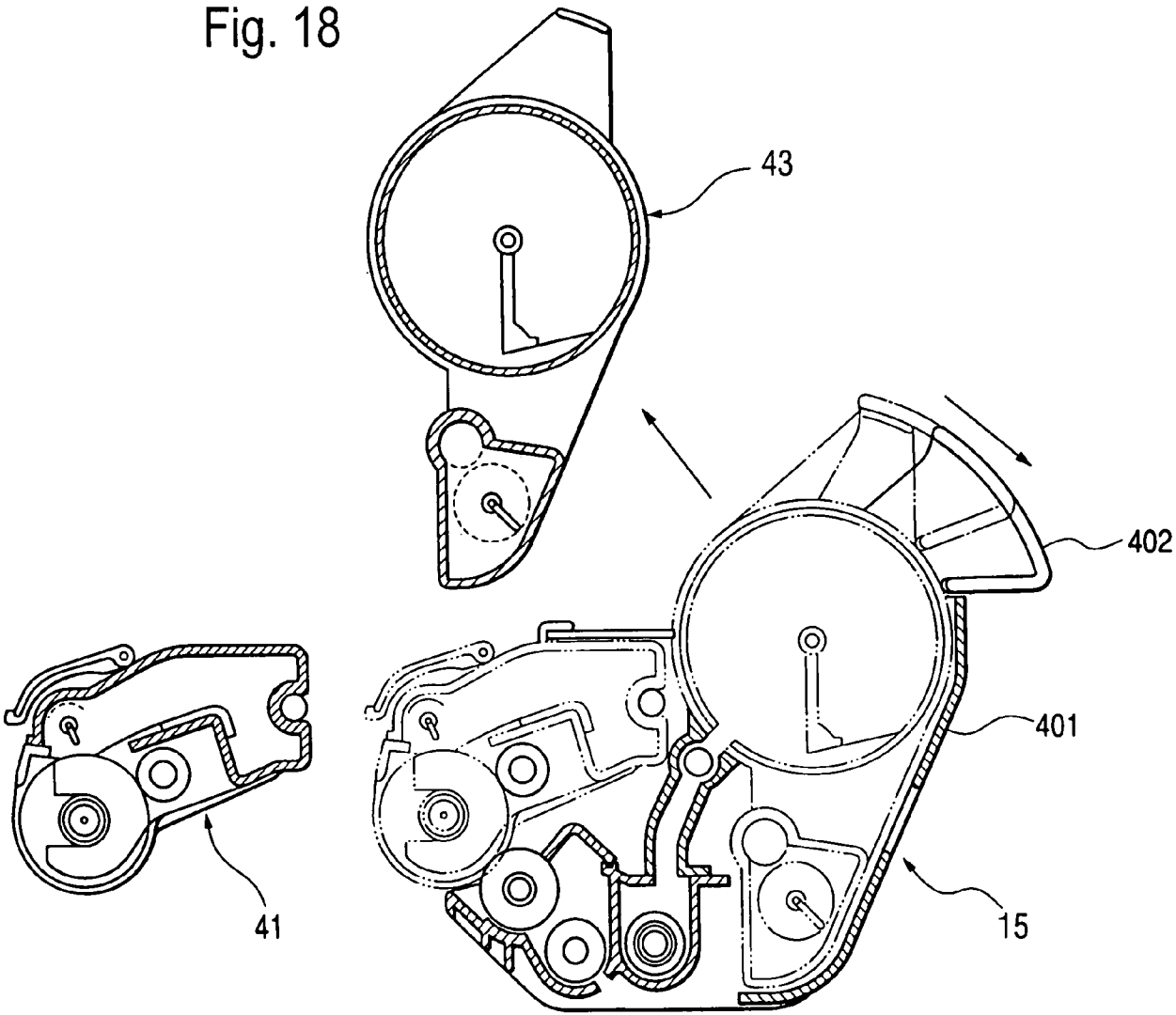
FIG. 18 is an explanatory diagram for explaining a relationship among the process cartridge, developer replenishment box, and waste developer recovering box.

In this case, as shown in FIG. 18, the movable holder 402 of the cartridge holder 401 is turned and moved to release the toner cartridge 43 from its constrained state by the movable holder 402. Thereafter, one pulls the toner cartridge 43 upward from the cartridge holder 401.

Figure 19:
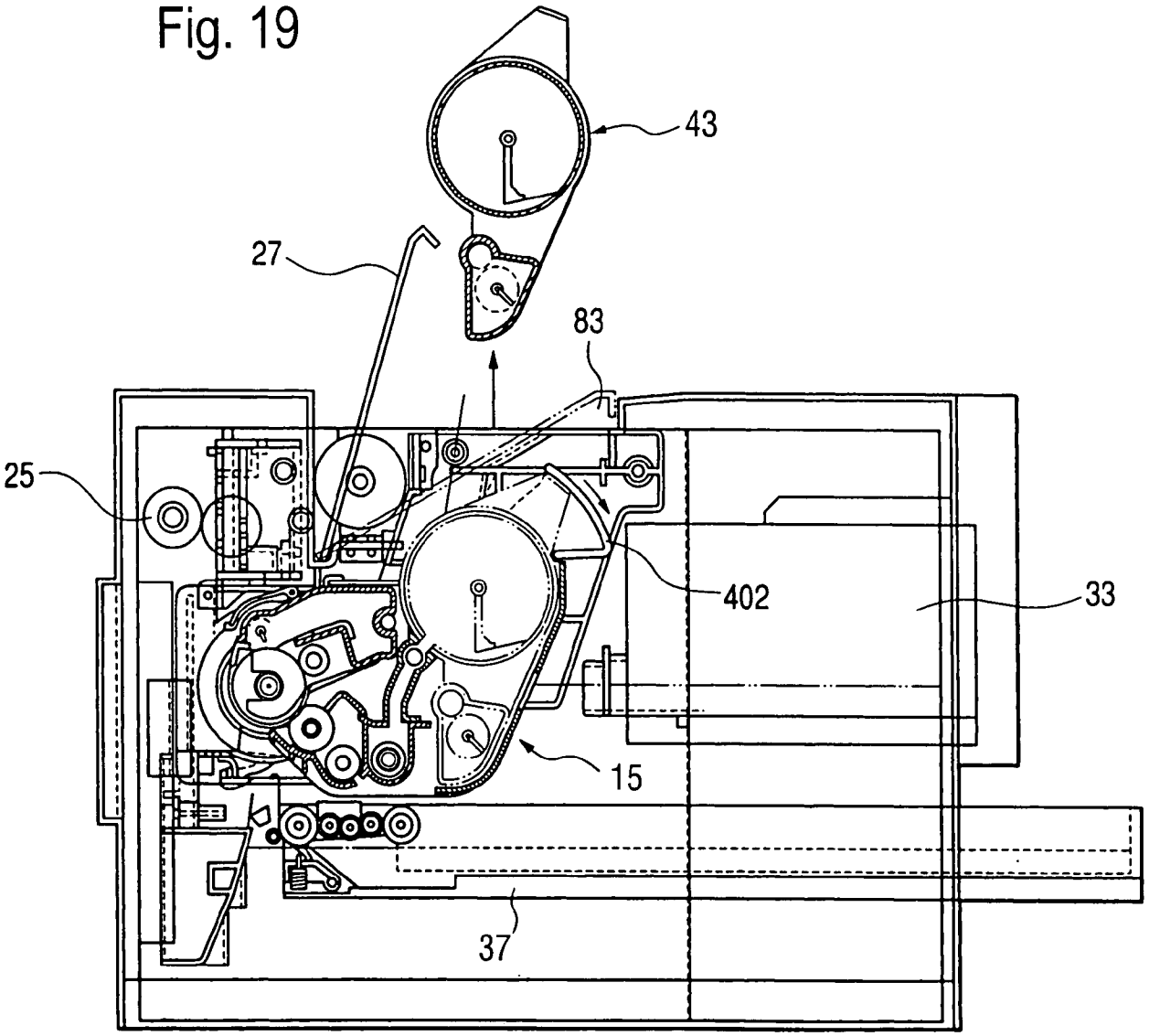
FIG. 19 is an explanatory diagram for exemplarily explaining the replacing work of the developer replenishment box and the waste developer recovering box.

In the embodiment, the toner cartridge 43 may be replaced with another cartridge after the process cartridge 15 is pulled out of the developing unit apparatus body 19. The toner cartridge 43 may be replaced, without taking the process cartridge 15 off the apparatus body 19, in a manner that as shown in FIG. 19, the restraining state of the toner cartridge 43 by the movable holder 402 is removed, and thereafter, the toner cartridge 43 is pulled out the toner cartridge 43 from the process cartridge 15 in the upward direction. When this method is used, the replacing work of the toner cartridge 43 is maintained in good conditions.

Particularly, in the instant embodiment, the photosensitive cartridge 41 and the toner cartridge 43 are detachably attached to the process cartridge 15, and hence the life times of those cartridges are different from one another. However, it is preferable to use those cartridges till those are expired in life time.

In the embodiment, the toner replenishment box 63 and the waste developer recovering box 67 are incorporated into the toner cartridge 43. Therefore, if the toner cartridge 43 is replaced with another toner cartridge, the toner replenishment box 63 and the waste developer recovering box 67 are also replaced both at once with new ones.

Accordingly, in the embodiment, there is no need of using an additional cartridge for collecting the waste toner. In this respect, the operability improvement and the cost reduction are both achieved. A replenishment toner emptiness is detected and the replacing timing of the toner cartridge 43 is determined by using the emptiness. Therefore, there is no need of detecting the waste developer fullness of the waste developer recovering box 67.

Figure 20:
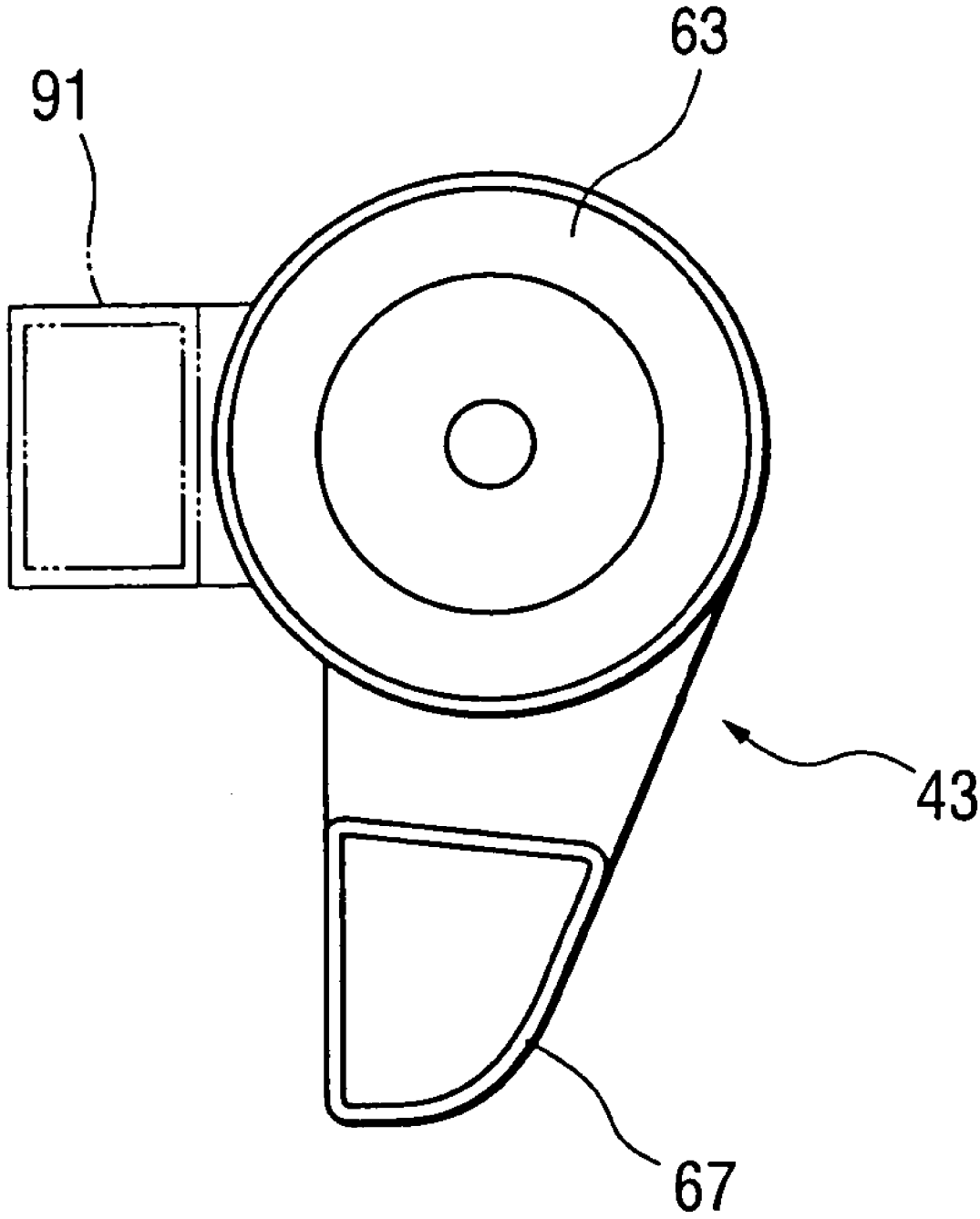
FIG. 20 is an explanatory diagram for explaining modifications of the developer replenishment box and the waste developer recovering box.

In the embodiment, the toner cartridge 43 is provided with the toner replenishment box 63 and the waste developer recovering box 67. If necessary, a waste developer recovering box 91 which receives waste toner from the cleaning unit 17 and stores the waste toner may be attached additionally, for example, as shown in FIG. 20.

Figure 21:
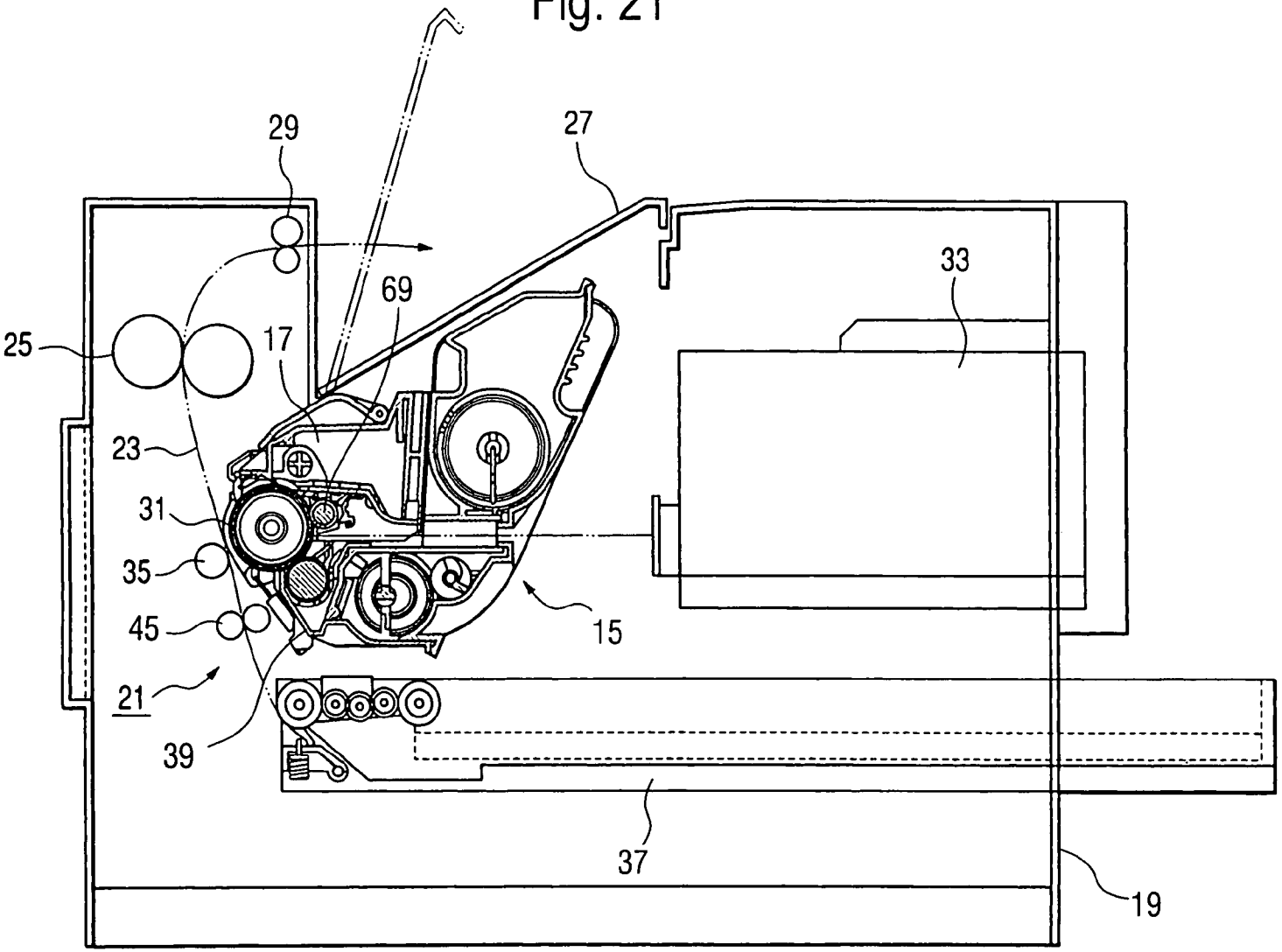
FIG. 21 is an explanatory diagram for explaining an overall arrangement of an image forming apparatus which constitutes another embodiment of the invention.
Figure 22:
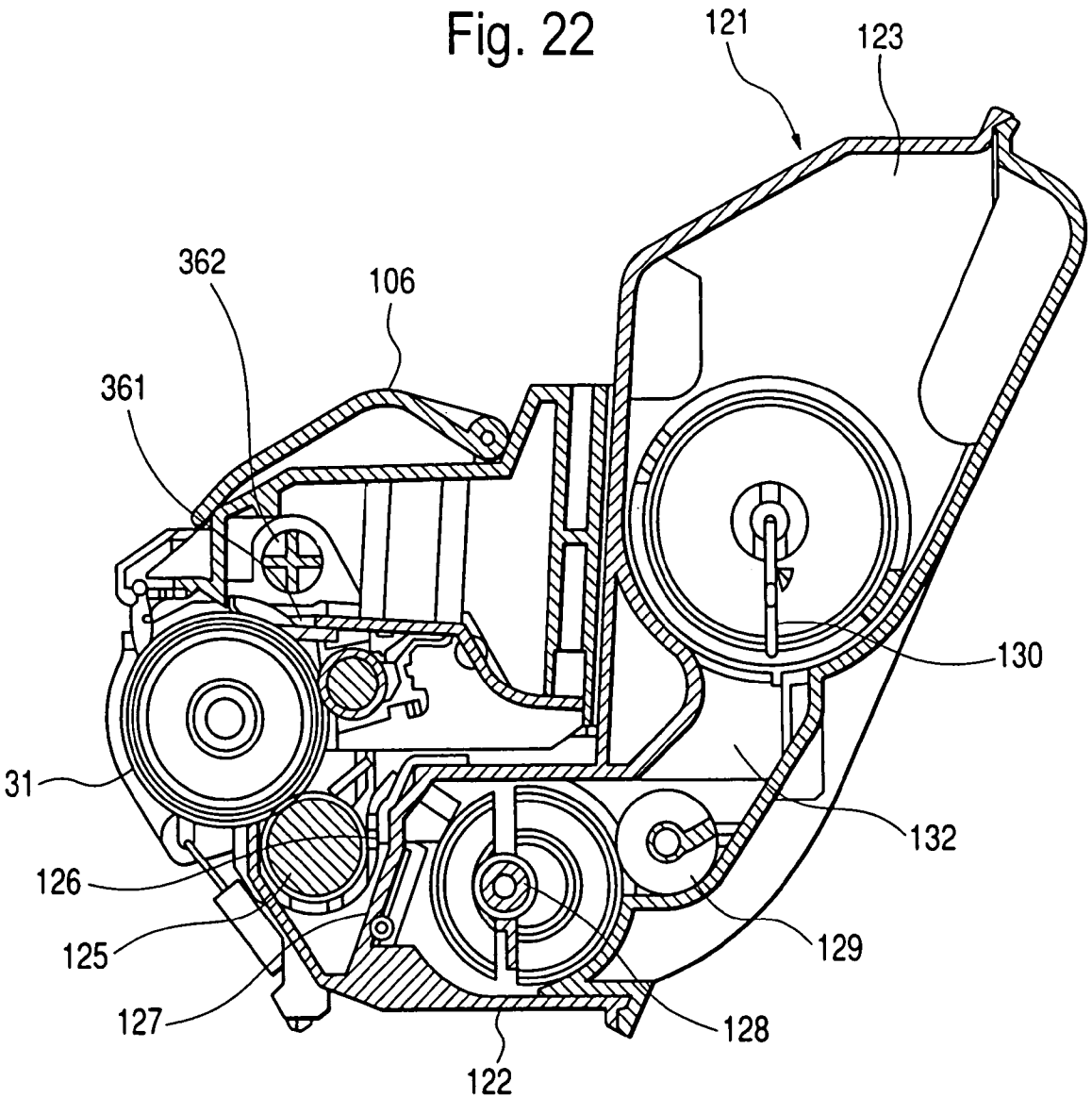
FIG. 22 is a cross sectional view showing the detail of a toner replenishing path portion of the process cartridge used in the embodiment.

Another embodiment of an image forming apparatus according to the present invention is shown in FIG. 21.

In the figure, a basic arrangement of the image forming apparatus, as in the embodiment 1, an image forming engine 21, which is based on the electrophotography, for example, (most of the devices are contained in the process cartridge 15) is provided in the apparatus body 19. A sheet supply unit 37 is disposed under the image forming engine 21 within the apparatus body 19. An upper part of the apparatus body 19 is formed as a discharge tray 27. A sheet transporting path 23 is provided on the rear side (corresponding to the left side in FIG. 21) within the apparatus body 19, while being directed substantially vertically. The sheet transporting path 23 receives a recording sheet delivered from the sheet supply unit 37, and leads it to the image forming engine 21 and the discharge tray 27. Difference between the instant embodiment and the embodiment 1 is a mechanical arrangement of the process cartridge 15.

Figure 25:
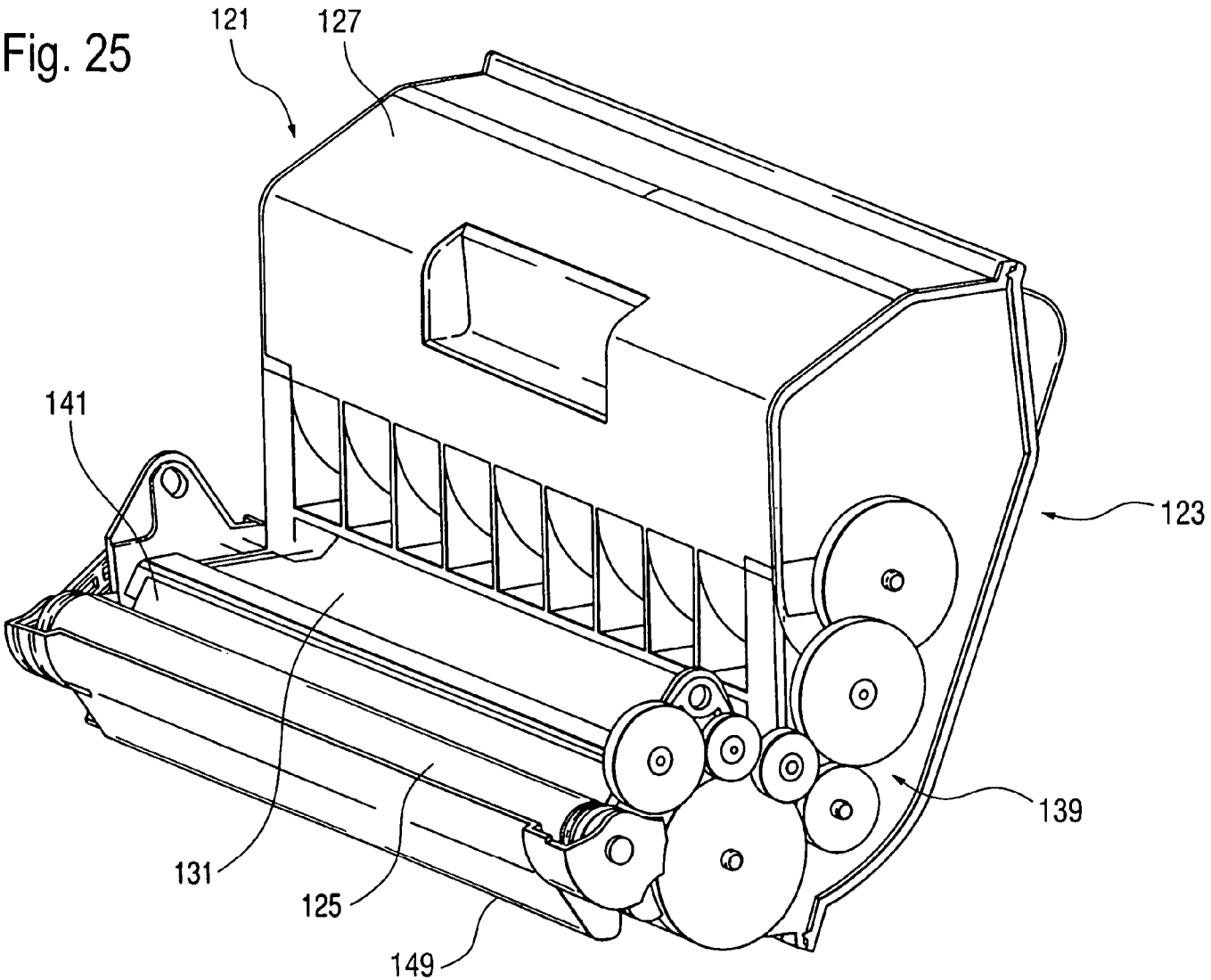
FIG. 25 is an explanatory diagram showing the developer cartridge when the rear cover is removed.

As shown in FIG. 25, a photosensitive cartridge 101 and a developer cartridge 123 are combined into a single unit, or the process cartridge 15. As in the embodiment 1, the opening/closing cover 82 of the upper part of the apparatus body 19 is opened, and the process cartridge is attached to and detached from the apparatus body 19.

In the embodiment, the photosensitive cartridge 101 is supported by pins 151 with respect to the developer cartridge 123 in a swingable fashion, and held while being pressed in a predetermined direction by an urging spring 152.

The components constituting the sub-cartridges 100 and 120, which form the process cartridge 15, will be described in detail.

Figure 23:
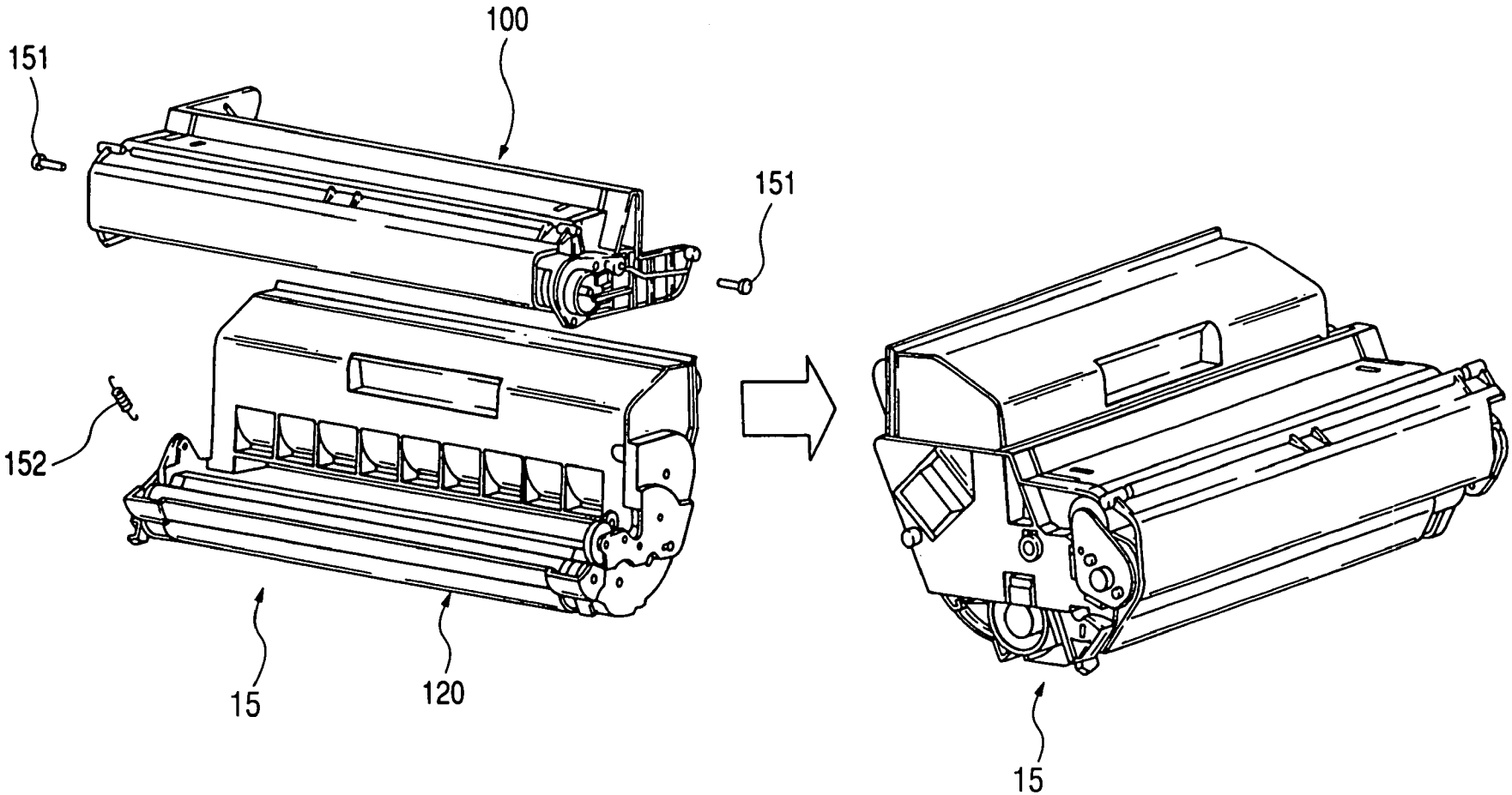
FIG. 23 is an explanatory diagram for explaining a sub-cartridge construction of the process cartridge of the embodiment.
Figure 24:
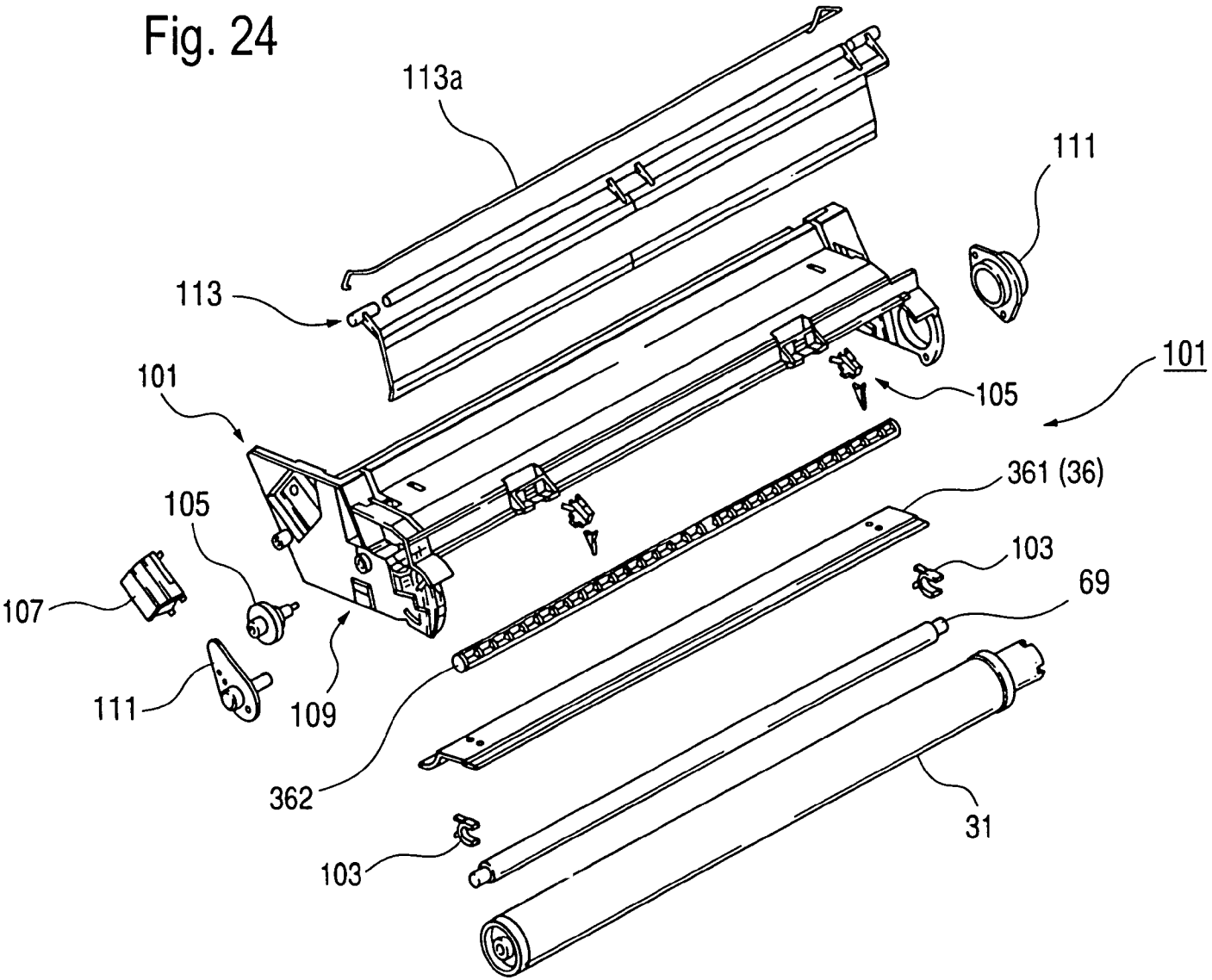
FIG. 24 is a perspective view showing an overall construction of a developer cartridge, which is based on the invention.
Figure 26:
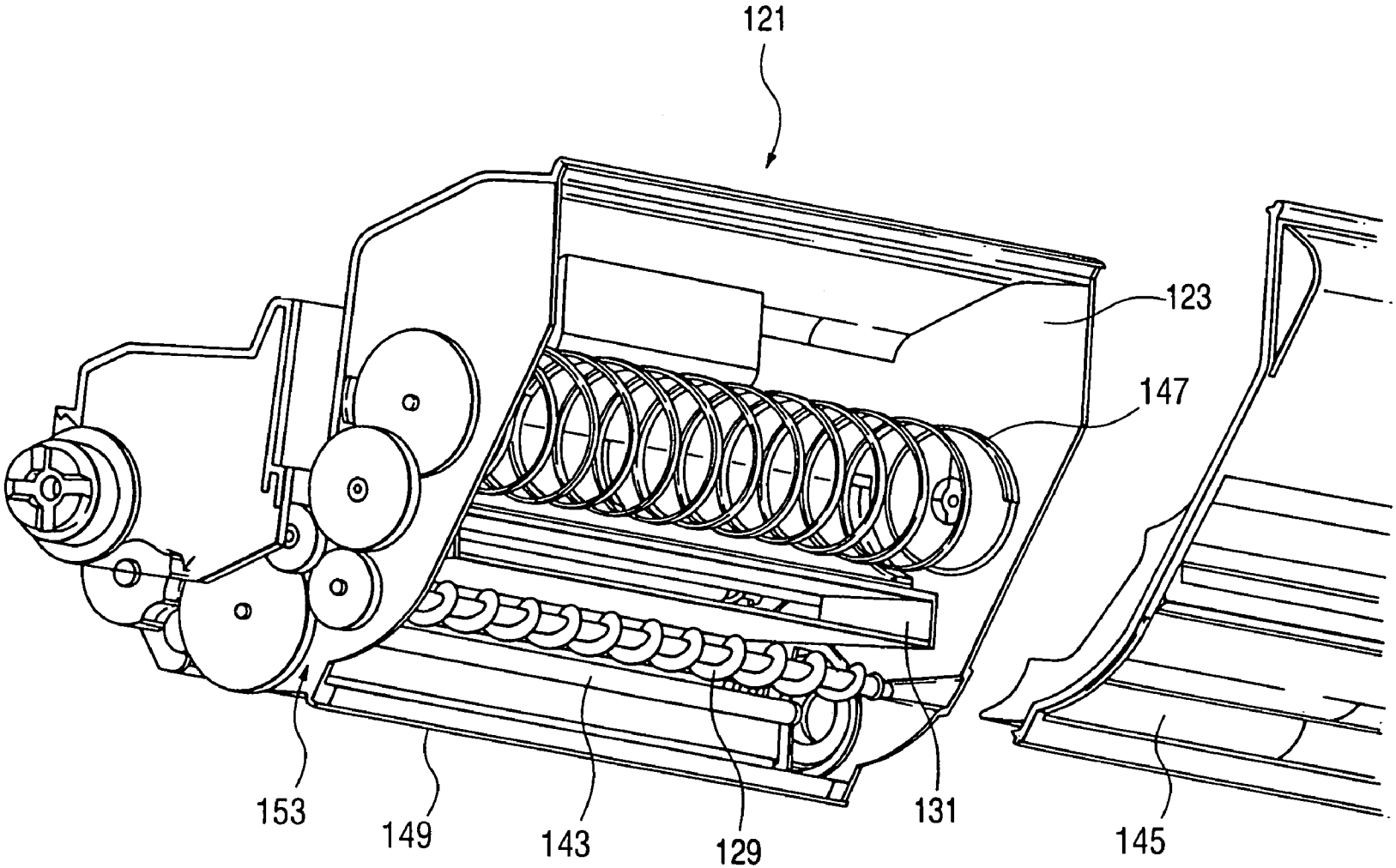
FIG. 26 is an exploded perspective view illustrating a developer cartridge used in the embodiment.

The photosensitive cartridge 101, as shown in FIGS. 23 and 26, has the photosensitive drum 31, the charging unit (charging roll) 32 for charging the photosensitive drum, and the cleaning unit 17 (including the cleaning blade 361 and the transporting paddle 362 in this instance) for cleaning the photosensitive drum 31, which are held in the cartridge case 101.

As shown FIG. 26, the photosensitive drum 31 and the charging unit 69 are rotatably supported on the cartridge case 101, with the aid of a drum bearing 111 and a roll bearing 103. The transporting paddle 362 is driven to rotate through a paddle gear 105. Further, a separation finger 105 for separating the recording sheet is provided downstream of the transfer stage.

In FIG. 26, reference numerals 113 and 113*a* are a shutter provided on the cartridge case 101 and its shaft. The shutter 113 functions to open and close a developing area surface on the photosensitive drum 31. Reference numeral 107 designates a cram assembly for storing information on the photosensitive cartridge 101, and reference numeral 109 designates a feeder plate for feeding electric power from the apparatus body to the charging roll.

Figure 27:
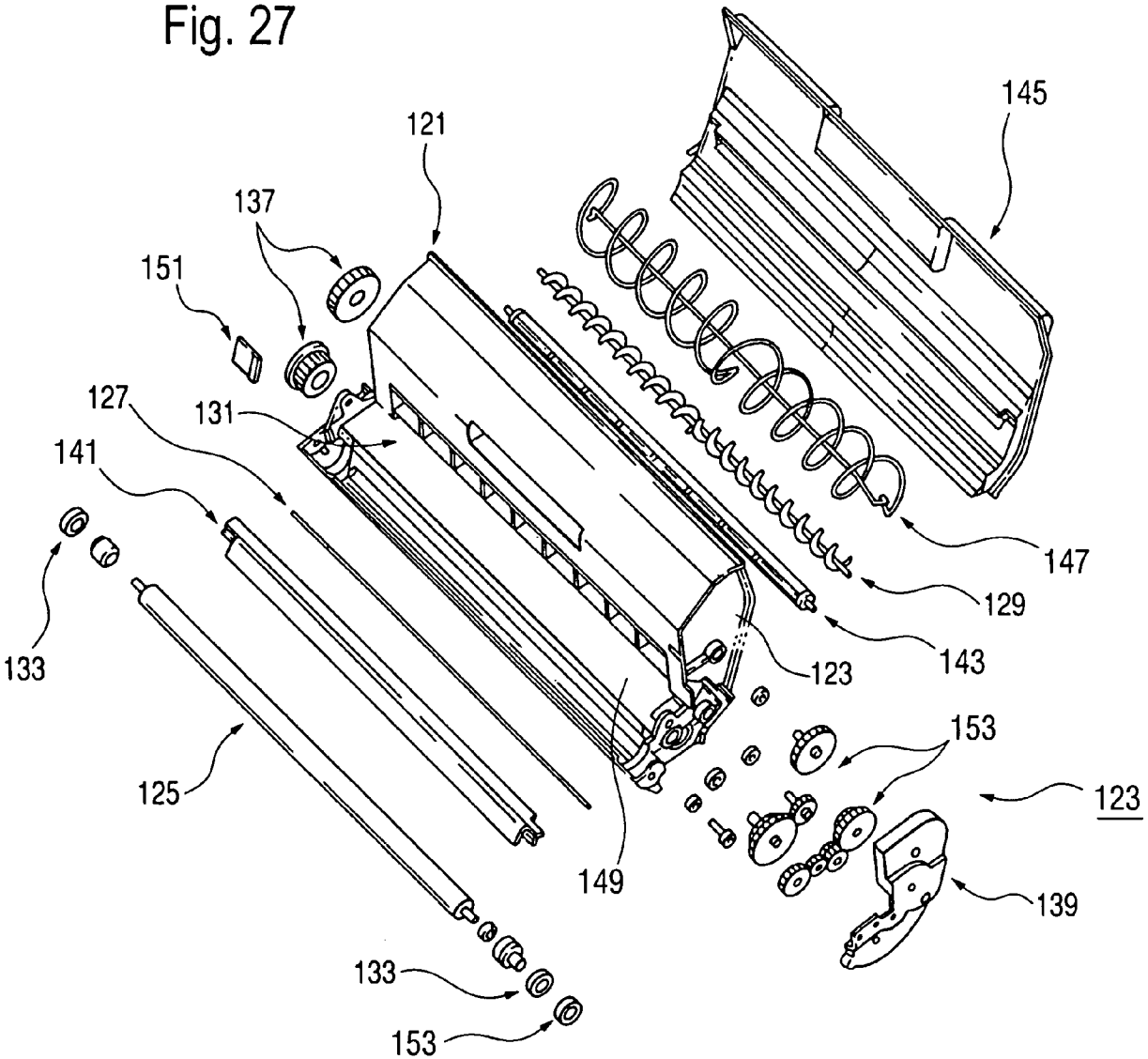
FIG. 27 is an exploded, perspective view showing a photosensitive cartridge 100 used in the embodiment.

The developer cartridge 123 is based on the one-component development, for example. As shown in FIGS. 23 and 27, the cartridge case 121 is provided with a developing housing 149 and a toner replenishment box 123. A developing roll 125 is disposed at a location opposed to the photosensitive drum 31 of the developing housing 149. A layer-thickness regulating blade 141 for regulating a thickness of the developer layer is disposed around the developing roll 125. An auxiliary agitator 127 for agitating the toner is disposed on the rear side of the developing roll 125. An agitator 143 for transporting replenishing toner to the developing roll is disposed on its rear side. A dispense auger 129 is further disposed on its rear side, and uniformly transports the toner as supplied to the developing housing 149.

A toner agitator 147 is provided within the toner replenishment box 123, and agitates the replenishing toner and transports it to the toner replenishment ducts 132.

In the embodiment, a scanning passage 131 is formed in the cartridge case 121 at a location between the developing housing 149 and the toner replenishment box 123. The scanning passage 131 allows a scanning light beam emitted from the exposure unit 33 to pass therethrough. The toner replenishment ducts 132 are provided at both end positions out of the scanning passage 131 of the cartridge case 121.

The toner replenishment ducts are provided for communicatively connecting the developing housing 149 and the toner replenishment box 123.

Accordingly, in the embodiment, particularly as shown in FIG. 23, the toner replenishment box 123 is disposed in an upstream (on the upper side in this instance) of the latent image writing position P of the photosensitive drum 31. The developing housing 149 is disposed in a downstream (on the lower side in this instance) of the latent image writing position P.

In FIG. 29, reference numeral 133 is a tracking cap for adjusting a gap between the developing roll 125 and the photosensitive drum 31; 153 is drive force transmission gear; 151 is a seal member of the developing roll 125; 137 is a toner cap; 153 is a drive force transmission gear train for transmitting a drive force to the agitators; and 139 and 145 are a side cover and a rear cover for covering the side and the rear portions of the cartridge case 121.

Operation of the image forming apparatus thus constructed will be described.

An image forming process in the instant embodiment is substantially the same as in the embodiment 1.

In the image forming process, a scanning light beam emitted from the exposure unit 33 travels through the scanning passage 131 of the process cartridge 15 and reaches the latent image writing position P on the photosensitive drum 31. Therefore, there is no chance that the process cartridge 15 impairs the exposure scanning performance of the exposure unit 33.

In the embodiment, the developing housing 149 of the developer cartridge 123 and the toner replenishment box 123 are vertically separated with respect to the latent image writing position P of the photosensitive drum 31. Those are communicatively coupled with each other by way of the toner replenishment ducts 132 which make a detour around the scanning passage 131. Therefore, the toner replenishing is performed without impairing the exposure scanning performance.

Figure 28:
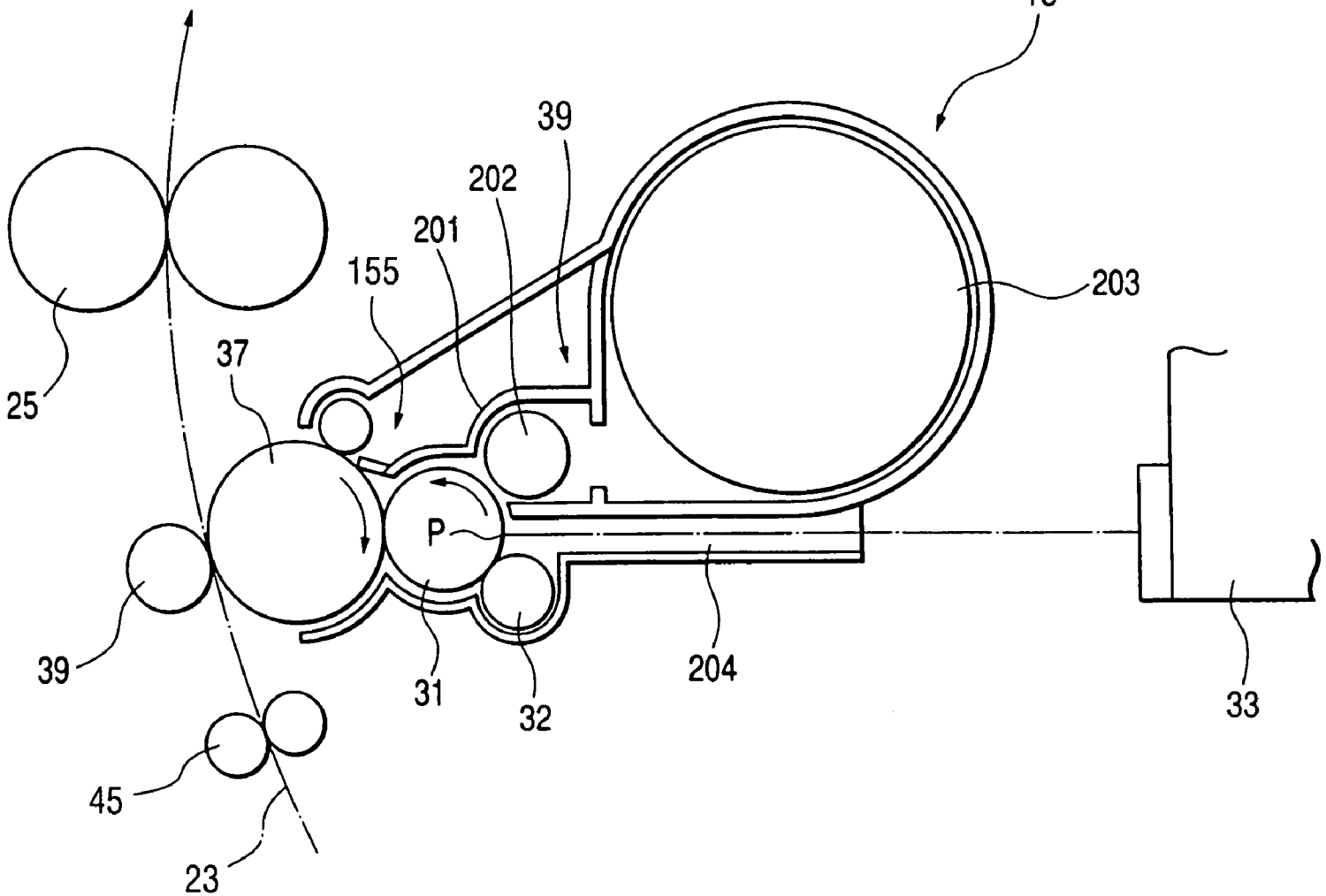
FIG. 28 is an explanatory diagram showing an overall construction of an image forming apparatus according to another embodiment of the invention.

In the developing unit 39, as the image forming process progresses, the toner is consumed in the developing unit 39. However, the toner in the toner replenishment box 123, as shown in FIG. 28, for example, is transported to the dispense auger 129 part of the developing housing 149 by way of the toner replenishment ducts 132, and is successively supplied into the developing housing 149 with rotation of the dispense auger 129.

Thereafter, as shown in FIG. 23, the new toner supplied into the developing housing 149 is transported to the developing roll by the agitator 143, and agitated by the auxiliary agitator 127 and supplied to the developing roll 125. The developer held by the developing roll 125 is regulated in thickness by the layer-thickness regulating blade 141, and then supplied to the developing area associated with the photosensitive drum 31.

In this way, with progress of toner consumption, the toner replenishing operation is performed.

In this embodiment, the toner replenishment box 123 is disposed in the upper part of the latent image writing position P of the photosensitive drum 31. Therefore, the bottom of the process cartridge 15 may be set to be higher than that in the case where it is disposed in the lower part. With this feature, as in the embodiment 1, there is eliminated a layout limit imposed onto the sheet supply unit 37 and the like, which are disposed in a lower part of the apparatus body 19.

In the instant embodiment, the toner replenishment box 123 is disposed upstream (on the upper side in this instance) of the latent image writing position P of the photosensitive drum 31. Accordingly, a space occupied by the process cartridge in an upper part of the scanning light line in the apparatus body 19 is increased and larger than that in the comparative example. As in the embodiment 1, the space in the lower part of the discharge tray 27 within the apparatus body 19 is the dead space D. The embodiment merely effectively utilizes the dead space, and hence there is no need of greatly changing the specifications of the upper part of the apparatus body 19.

Even in such a case of increasing the toner replenishing amount of the toner replenishment box 123, if the space of the upper part within the apparatus body 19 is effectively used, it is required to little change the specifications on the upper part (vicinal region around the discharge tray 27) of the apparatus body 19.

For this reason, in constructing the image forming apparatuses of various specifications, the apparatus body 19 may be used in common for those different image forming apparatuses.

Even in a case where the upper part specifications of the apparatus body 19 are unavoidably changed, such a minute change of the specifications as somewhat raising of the discharge tray 27, suffices.

FIG. 30 is a diagram showing an embodiment 3 of an image forming apparatus according to of the invention.

In the figure, as in a previous embodiment, the image forming apparatus is arranged such that the recording sheet is transported upward along the substantially vertical direction. The embodiment uses the process cartridge 15, which is different from that in the embodiments 1 and 2. In the embodiment, like reference numerals are used for designating like or equivalent constituent components in the embodiments 1 and 2, and hence the detailed description of them are omitted.

In the instant embodiment, the process cartridge 15 includes a photosensitive drum 31, a charging unit 69 (charging roll in this instance) for charging the photosensitive drum 31, a developing unit 39 for developing the latent image written onto the photosensitive drum 31, an intermediate transfer drum 37 for temporarily holding the visual image formed on the photosensitive drum 31, and a cleaning unit 155 for removing toner left on the photosensitive drum 31. In the figure, reference numeral 39 denotes a transfer device (transfer roll in this instance) for transferring a visual image (toner image) from the intermediate transfer drum 37 onto the recording sheet.

In particular, in the embodiment, the developing unit 39 is designed to be capable of supplying toner. A developing roll 202 is incorporated into the developing housing 201. A toner replenishment box 203 is communicatively connected to the developing housing 201. The developing housing 201 and the toner replenishment box 203 are disposed in an upper part (downstream in this instance) of the latent image writing position P on the photosensitive drum 31. In the instant embodiment, the developing method is not limited to the one-component developing system, the two-component developing system or the like. The embodiment employs such a developing system that the developing roll 202, for example, holds the carrier and the carrier holds toner, and the resultant developer is supplied to the developing area.

The charging unit 69 is disposed on the lower side (downstream in this instance) of the latent image writing position P on the photosensitive drum 31.

A scanning passage 204 along which the scanning light beam emitted from the exposure unit 33 passes is secured in the process cartridge 15.

Operation of the thus constructed image forming apparatus of the embodiment will b described.

In FIG. 30, in the process cartridge 15, the photosensitive drum 31 is charged by the charging unit 69, a latent image is formed on the photosensitive drum 31 by the exposure unit 33, and then it is developed into a visual image (toner image) by the developing unit 39.

Thereafter, the visual image on the photosensitive drum 31 is transferred onto the intermediate transfer drum 37.

A recording sheet is fed from a sheet supply unit, not shown, at a predetermined timing to the sheet transporting path 23, and transferred to the transfer stage.

The toner image on the intermediate transfer drum 37 is transferred onto the recording sheet by the transfer unit 39, the toner image not yet transferred is fused and fixed on the recording sheet by the fixing unit 25, and the recording sheet having the toner image fixed thereon is discharged into a discharge tray (not shown). The residual toner on the intermediate transfer drum 37 is removed by the cleaning unit 155. In this case, the brush cleaning system is generally used for the cleaning system of the intermediate transfer drum 37. It is frequent to additionally use a flicker bar for scraping the toner off the brush.

During such an image forming process, a scanning light beam emitted from the exposure unit 33 reaches the latent image writing position P on the photosensitive drum 3 1, through the scanning passage 204 of the process cartridge 15. Therefore, there is no chance that the process cartridge 15 impairs the exposure scanning performance of the exposure unit 33.

In the developing unit 39, as the image forming process progresses, the amount of toner consumption increases, and new tone is successively replenished from the toner replenishment box 203 to the developing housing 201 in accordance with an algorithm of toner replenishment control unit, not shown, and then is used for the development of the latent image by the developing roll.

In the embodiment, the process cartridge 15 is disposed in an upper part of the latent image writing position P on the photosensitive drum 3 1. Therefore, if an opening/closing cover (not shown) is provided in an upper part of the apparatus body, one may easily attach the process cartridge 15 to and detach it from the apparatus body by opening the opening/closing cover.

In the embodiment, in the developing unit 39 of the process cartridge 15, the developing housing 201 and the toner replenishment box 203 are disposed in an upper part of the scanning light beam position of the exposure unit 33. Therefore, the upper space of the apparatus body is effectively utilized while being free from the formation of the dead space. Further, for example, in a case where such a change to the specification as to change the toner replenishing amount is required, a designer may readily deal with the specification change by effectively utilizing the upper space of the apparatus body, without little affecting other component parts.

As seen from the foregoing description, the unique and inventive technical idea is introduced to the layout of the developer replenishment box, viz., the developer replenishment box is disposed upstream of the latent image writing position on the charging unit. Therefore, the developer replenishing function is effectively secured while satisfying the size reduction and common usability of the apparatus.

In the invention, the developer replenishment box is disposed upstream of the latent image writing position on the charging unit. In the image forming apparatus of the type in which a recording sheet is transported substantially vertically and upward, the upper space at the latent image writing position is effectively used for the developer replenishment space, while it does not become the dead space. For example, in a case where such a change to the specification as to change the developer replenishing amount is required, a designer may readily deal with the specification change, without little affecting other component parts. And the common usability of the apparatus body is achieved.

According to another aspect of the invention, there is provided an image forming apparatus of the type in which a recording sheet is transported substantially vertically and upward, wherein a developing housing and a developer replenishment box are disposed in an upper part of the latent image writing position on the image carrying body, and an image is transferred onto a recording sheet with the aid of an intermediate transfer body. Therefore, the upper space of the apparatus body may be effectively used for the developer replenishment space. In a case where such a change to the specification as to change the developer replenishing amount is required, a designer may readily deal with the specification change, without little affecting the apparatus body, and the common usability of the apparatus body is realized.

In particular, the lower space of the latent image writing device of the image carrying body is minimized, thereby reducing the vertical dimension of the apparatus.

With use of a process cartridge and a developing unit, which are both used for the image forming apparatus of the invention, it is easy to construct an image forming apparatus which is capable of efficiently securing the replenishing function of the developer while satisfying the requirements of the size reduction and common usability of the image forming apparatus, and with a minimum chance of forming the dead space within the machine.

What is claimed is:

1. An image forming apparatus comprising:

an image forming apparatus main body in which an ejection tray is provided at an upper portion thereof;

a recording medium storage section arranged along a substantially horizontal direction;

a transport path for transporting a recording medium supplied from the recording medium storage section along a substantially vertical direction, and for ejecting the transported recording medium to the ejection tray of the image forming apparatus main body, the ejection tray storing the ejected recording medium;

an image carrier;

an optical writing section for forming an electrostatic latent image on the image carrier; and a developing section for developing the electrostatic latent image formed on the image carrier to produce a visible image, wherein the developing section owns a developer storage space, which includes a first developer storage portion and a second developer storage portion, for storing developer;

the developer is dropped from the first developer storage portion to the second developer storage portion;

a developer housing including the second developer storage portion is communicatively connected to a developer replenishment box including the first developer storage portion;

the ejection tray is disposed in an upper part of the developer replenishment box;

an upper surface housing of the developer replenishment box inclines in substantially the same direction as the ejection tray inclines; and a latent image writing position of the image carrier written by the optical writing section is located lower than at least a portion of the developer storage space along the vertical direction.

2. The image forming apparatus according to claim 1, wherein the optical writing section comprises a scanning type laser exposing apparatus, and the scanning type laser exposing apparatus is arranged along the substantially horizontal direction.

3. The image forming apparatus according to claim 1, wherein the optical writing section is arranged on the side of a front surface of the image forming apparatus main body within the image forming apparatus main body.

4. The image forming apparatus according to claim 1, wherein a control board is arranged between the ejection tray of the image forming apparatus main body and the optical writing section.

5. The image forming apparatus according to claim 1, wherein an interface board is arranged between the ejection tray of the image forming apparatus main body and the optical writing section.

6. The image forming apparatus according to claim 1, wherein a developer storage vessel that stores therein to the developer arranged between the ejection tray of the image forming apparatus main body and the optical writing section.

7. An image forming apparatus according to claim 2, wherein the developer storage space owns a window portion which constitutes an optical scanning path defined from the optical writing section to the image carrier.

8. The image forming apparatus according to claim 7, wherein the first developer storage portion is arranged at an upper portion thereof, and the second developer storage portion is arranged at a lower portion thereof, while the window portion is set to a boundary.

9. The image forming apparatus according to claim 1, wherein at least a portion of the optical writing section is arranged to be overlapped with respect to the developer storage space along a direction in parallel to an optical axis of incident light to the image carrier.

10. The image forming apparatus according to claim 1, wherein the ejection tray is freely pivotable.

11. The image forming apparatus according to claim 1, further comprising:

a process cartridge containing the image carrier, a cleaning device and the developing section, wherein the cleaning device removes developer remaining on the image carrier; and the process cartridge includes a third developer storage portion into which the developer removed by the cleaning device is deposited.

12. The image forming apparatus according to claim 11, wherein a first unit of the process cartridge, which includes the image carrier, the cleaning device and the third developer storage portion, is detachable from a second unit of the process cartridge, which includes the developing section.

* * * * *